US007954461B2

(12) United States Patent
Branyon et al.

(10) Patent No.: US 7,954,461 B2
(45) **Date of Patent: *Jun. 7, 2011**

(54) SPLIT-CYCLE FOUR-STROKE ENGINE

(75) Inventors: David P. Branyon, San Antonio, TX (US); Jeremy D. Eubanks, San Antonio, TX (US)

(73) Assignee: Scuderi Group, LLC, West Springfield, MA (US)

( * ) Notice: Subject to any disclaimer, the term of this patent is extended or adjusted under 35 U.S.C. 154(b) by 334 days.

This patent is subject to a terminal disclaimer.

(21) Appl. No.: 12/283,522

(22) Filed: Sep. 12, 2008

(65) Prior Publication Data

US 2009/0229587 A1 Sep. 17, 2009

Related U.S. Application Data

(63) Continuation of application No. 11/890,360, filed on Aug. 6, 2007, now abandoned, which is a continuation of application No. 11/197,999, filed on Aug. 4, 2005, now Pat. No. 7,588,001, which is a continuation of application No. 10/864,748, filed on Jun. 9, 2004, now Pat. No. 6,952,923.

(60) Provisional application No. 60/480,342, filed on Jun. 20, 2003.

(51) Int. Cl.
*F02B 33/00* (2006.01)
*F02B 25/00* (2006.01)

(52) U.S. Cl. ..... 123/68; 123/70 R

(58) Field of Classification Search ..... 123/68, 123/70 R

See application file for complete search history.

(56) References Cited

U.S. PATENT DOCUMENTS

| | | | |
|---|---|---|---|
| 810,347 | A | 1/1906 | Porter |
| 848,029 | A | 3/1907 | Haselwander |
| 939,376 | A | 11/1909 | Appleton |
| 1,062,999 | A | 5/1913 | Webb |
| 1,111,841 | A | 9/1914 | Koenig |
| 1,248,250 | A | 11/1917 | Bohler |
| 1,301,141 | A | 4/1919 | Leadbetter |
| 1,372,216 | A | 3/1921 | Casaday |
| 1,392,359 | A | 10/1921 | Rudvist |

(Continued)

FOREIGN PATENT DOCUMENTS

DE 2515271 10/1976

(Continued)

OTHER PUBLICATIONS

Tiainen et al., Novel Two-Stroke Engine Concept, Feasibility Study, SAE Technical Paper Series, 2003-01-3211.

(Continued)

*Primary Examiner* — Noah Kamen
(74) *Attorney, Agent, or Firm* — Fildes & Outland, P.C.

(57) ABSTRACT

An engine has a crankshaft, rotating about a crankshaft axis of the engine. An expansion piston is slidably received within an expansion cylinder and operatively connected to the crankshaft such that the expansion piston reciprocates through an expansion stroke and an exhaust stroke of a four stroke cycle during a single rotation of the crankshaft. A compression piston is slidably received within a compression cylinder and operatively connected to the crankshaft such that the compression piston reciprocates through an intake stroke and a compression stroke of the same four stroke cycle during the same rotation of the crankshaft. A ratio of cylinder volumes from BDC to TDC for either one of the expansion cylinder and compression cylinder is fixed at substantially 26 to 1 or greater.

30 Claims, 29 Drawing Sheets

U.S. PATENT DOCUMENTS

| | | | |
|---|---|---|---|
| 1,751,385 | A | 3/1930 | Beaudry |
| 1,856,048 | A | 4/1932 | Ahrens |
| 1,904,816 | A | 4/1933 | Beaudry |
| 1,969,815 | A | 8/1934 | Meyer |
| 2,091,410 | A | 8/1937 | Mallory |
| 2,091,411 | A | 8/1937 | Mallory |
| 2,091,412 | A | 8/1937 | Mallory |
| 2,091,413 | A | 8/1937 | Mallory |
| 2,154,856 | A | 4/1939 | Mallory |
| 2,269,948 | A | 1/1942 | Mallory |
| 2,280,712 | A | 4/1942 | Mallory |
| 2,957,455 | A | 10/1960 | Bonvy |
| 2,974,541 | A | 3/1961 | Dolza |
| 3,623,463 | A | 11/1971 | De Vries |
| 3,774,581 | A | 11/1973 | Lundv |
| 3,895,614 | A | 7/1975 | Bailey |
| 4,215,659 | A | 8/1980 | Lowther |
| 4,450,754 | A | 5/1984 | Liljequist |
| 4,628,876 | A | 12/1986 | Fujikawa |
| 4,696,158 | A | 9/1987 | DeFrancisco |
| 4,805,571 | A | 2/1989 | Humphrey |
| 4,945,866 | A | 8/1990 | Chabot |
| 4,955,328 | A | 9/1990 | Sobotowski |
| 5,146,884 | A | 9/1992 | Merkel |
| 5,158,047 | A | 10/1992 | Schaal |
| 5,499,605 | A | 3/1996 | Thring |
| 5,546,897 | A | 8/1996 | Brackett |
| 5,623,894 | A | 4/1997 | Clarke |
| 5,711,267 | A | 1/1998 | Williams |
| 5,799,636 | A | 9/1998 | Fish |
| 5,950,579 | A | 9/1999 | Ott |
| 5,964,087 | A | 10/1999 | Tort-Oropeza |
| 5,992,356 | A | 11/1999 | Howell-Smith |
| 6,058,901 | A | 5/2000 | Lee |
| 6,202,416 | B1 | 3/2001 | Gray |
| 6,230,671 | B1 | 5/2001 | Achterberg |
| 6,340,004 | B1 | 1/2002 | Patton |
| 6,415,749 | B1 | 7/2002 | Sturman et al. |
| 6,543,225 | B2 | 4/2003 | Scuderi |
| 6,609,371 | B2 | 8/2003 | Scuderi |
| 6,655,327 | B1 | 12/2003 | Hedman |
| 6,722,127 | B2 | 4/2004 | Scuderi |
| 6,789,514 | B2 | 9/2004 | Suh |
| 6,880,502 | B2 | 4/2005 | Scuderi |
| 6,952,923 | B2 | 10/2005 | Branyon et al. |
| 6,986,329 | B2 | 1/2006 | Scuderi et al. |
| 7,007,639 | B1 | 3/2006 | Luttgeharm |
| 7,017,536 | B2 | 3/2006 | Scuderi |
| 7,121,236 | B2 | 10/2006 | Scuderi et al. |
| 7,353,786 | B2 | 4/2008 | Scuderi et al. |
| 7,481,190 | B2 | 1/2009 | Scuderi |
| 7,588,001 | B2 | 9/2009 | Branyon et al. |

FOREIGN PATENT DOCUMENTS

| | | |
|---|---|---|
| DE | 2628155 | 1/1978 |
| FR | 2416344 | 8/1979 |
| GB | 299602 | 11/1928 |
| GB | 383866 | 11/1932 |
| GB | 721025 | 12/1954 |
| IT | 505576 | 12/1954 |
| JP | 51-39306 | 4/1976 |
| JP | 51-91416 | 8/1976 |
| JP | 54-89108 | 7/1979 |
| JP | 56-145641 | 3/1980 |
| JP | 57-181923 | 11/1982 |
| JP | 60-143116 | 9/1985 |
| JP | 60-256642 | 12/1985 |
| JP | 62-126523 | 8/1987 |
| JP | 63-124830 | 5/1988 |
| JP | 5-502707 | 5/1993 |
| JP | 5-156954 | 6/1993 |
| JP | 6-159836 | 6/1994 |
| JP | 8-503043 | 4/1996 |
| JP | 8-158887 | 6/1996 |
| JP | 8-232675 | 9/1996 |
| JP | 8-261004 | 10/1996 |
| JP | 2000-508403 | 7/2000 |
| JP | 2001-12250 | 1/2001 |
| JP | 2001-207801 | 8/2001 |
| JP | 2002-506949 | 3/2002 |
| SU | 1551880 A1 | 3/1990 |
| WO | 0116470 A1 | 3/2001 |

OTHER PUBLICATIONS

Gronlund et al., Valve Train Design for a New Gas Exchange Process, SAE Technical Paper Series, 2004-01-0607, Mar. 2004.

Search Report by Patro Information K.K. of Tokyo, Japan, dated Jun. 20, 2002, signed by Teruaki Haga, Managing Director.

Thermodynamic Modeling of the Two-Cylinder Regenerative Internal Combustion Engine by Francisco Ruiz, SAE 1991 Transactions, Journal of Engines, Sec 3, vol. 100, p. 512-529.

Standard Search Report, No. RS 108446 US by the European Patent Office, dated May 23, 2003.

Certified U.S. Appl. No. 05/955,896, filed Oct. 30, 1978, titled "Internal Combustion Engine".

Certified U.S. Appl. No. 05/955,895, filed Oct. 30, 1978, titled "Two Stroke Internal Combustion Engine".

Certified U.S. Appl. No. 05/947,998, filed Oct. 2, 1978, titled "Hybrid Engine".

*FIG. 12B*

*ITEM DEFINITION: CONVENTIONAL ENGINE*

- 211,212 intake manifold junctions/tees
- intake: intake end environment (infinite ambient source)
- 214,215,216,217: intake ports
- 218,219,220,221 fuel injectors
- vix-y: intake valves
- cyl 1: conventional engine cylinder #1
- cyl 2: conventional engine cylinder #2
- vex-y exhaust valves
- 229,230,231,232 exhaust ports
- 233,234: exhaust junctions or tees
- exhaust: exhaust end environment (infinite ambient dump)
- canktrain: mathematical item for summing items from all engine cylinders and handling organization such as firing order
- 224-232 (not 228): "orifice" connections to handle connections between pipes and junctions in the model. These items do not represent anything in actual hardware.
- 243,248: mathematical links representing the mechanical connection between cylinders and the cranktrain.

*Summary of Conventional Engine Performance versus Engine Speed*

*FIG. 15B*

*ITEM DEFINITION: SPLIT-CYCLE ENGINE*

- intake: intake end environment (infinite ambient source)
- intk-bypass: single intake port before split
- intk-splitter: intake manifold junction/tee
- intport 1, intport 2: intake ports
- fuelinj 1, fuelinj 2, fuel injectors
- vil-y: intake valves
- comp: compression cylinder
- check: check or reed valve at discharge of compression cylinder
- crossover 1: crossover passage
- cross-valve: actuated crossover valve
- power: expansion or power cylinder
- vex: exhaust valves
- exhport 1, exhport 2: exhaust ports
- exh-jcn: exhaust junction/tee
- exhaust: exhaust end environment (infinite ambient dump)
- cranktrain: mathematical item for summing items from all engine cylinders and handling organization such as firing order.
- 222,223,226,227,245,246,247: "orifice" connections to handle connections between pipes and junctions in the model. These items do not representanything in actual hardware.
- 243,248 mathematical links representing the mechanical connection between cylinders and the cranktrain.

MSC. ADAMS® MODEL OF SPLIT-CYCLE ENGINE

*Summsary of Initial Split-Cycle Engine Performance versus Engine Speed*

Log-Log Pessure-Volume Diagam for Conventional Engine

Pressure-Volume Diagram for Split-Cycle Engine

Comparison of Split-Cycle Indicated Thermal Efficiencies

*35% BURN OVERLAP*

*5% BURN OVERLAP*

Predicted $NO_x$ emissions for all thee cases run

Expansion Piston Thrust Load as a Function of Burn Duration

Indicated Power and Thermal Efficiency versus Compression Ratio

Indicated Power and Thermal Efficiency versus Expansion Ratio

Indicted Power and Thermal Efficiency versus Crossover Valve Duration and Lift

SPLIT-CYCLE FOUR-STROKE ENGINE

CROSS REFERENCE TO RELATED APPLICATIONS

This patent application is a continuation of U.S. application Ser. No. 11/890,360, filed Aug. 6, 2007, now abandoned which is a continuation application of U.S. application Ser. No. 11/197,999, filed Aug. 4, 2005, now U.S. Pat. No. 7,588,001 titled Split-Cycle Four-Stroke Engine, which is a continuation application of U.S. application Ser. No. 10/864,748, filed Jun. 9, 2004, now U.S. Pat. No. 6,952,923, titled Split-Cycle Four-Stroke Engine, which claims the benefit of U.S. provisional application Ser. No. 60/480,342, filed on Jun. 20, 2003, titled Split-Cycle Four-Stroke Engine, all of which are herein incorporated by reference in their entirety.

FIELD OF THE INVENTION

The present invention relates to internal combustion engines. More specifically, the present invention relates to a split-cycle engine having a pair of pistons in which one piston is used for the intake and compression stokes and another piston is used for the expansion (or power) and exhaust strokes, with each of the four strokes being completed in one revolution of the crankshaft.

BACKGROUND OF THE INVENTION

Internal combustion engines are any of a group of devices in which the reactants of combustion, e.g., oxidizer and fuel, and the products of combustion serve as the working fluids of the engine. The basic components of an internal combustion engine are well known in the art and include the engine block, cylinder head, cylinders, pistons, valves, crankshaft and camshaft. The cylinder heads, cylinders and tops of the pistons typically form combustion chambers into which fuel and oxidizer (e.g., air) is introduced and combustion takes place. Such an engine gains its energy from the heat released during the combustion of the non-reacted working fluids, e.g., the oxidizer-fuel mixture. This process occurs within the engine and is part of the thermodynamic cycle of the device. In all internal combustion engines, useful work is generated from the hot, gaseous products of combustion acting directly on moving surfaces of the engine, such as the top or crown of a piston. Generally, reciprocating motion of the pistons is transferred to rotary motion of a crankshaft via connecting rods.

Internal combustion (IC) engines can be categorized into spark ignition (SI) and compression ignition (CI) engines. SI engines, i.e. typical gasoline engines, use a spark to ignite the air/fuel mixture, while the heat of compression ignites the air/fuel mixture in CI engines, i.e., typically diesel engines.

The most common internal-combustion engine is the four-stroke cycle engine, a conception whose basic design has not changed for more than 100 years old. This is because of its simplicity and outstanding performance as a prime mover in the ground transportation and other industries. In a four-stroke cycle engine, power is recovered from the combustion process in four separate piston movements (strokes) of a single piston. Accordingly, a four stroke cycle engine is defined herein to be an engine which requires four complete strokes of one of more pistons for every expansion (or power) stroke, i.e. for every stroke that delivers power to a crankshaft.

Referring to FIGS. 1-4, an exemplary embodiment of a prior art conventional four stroke-cycle internal combustion engine is shown at 10. The engine 10 includes an engine block 12 having the cylinder 14 extending therethrough. The cylinder 14 is sized to receive the reciprocating piston 16 therein. Attached to the top of the cylinder 14 is the cylinder head 18, which includes an inlet valve 20 and an outlet valve 22. The bottom of the cylinder head 18, cylinder 14 and top (or crown 24) of the piston 16 form a combustion chamber 26. On the inlet stroke (FIG. 1), a air/fuel mixture is introduced into the combustion chamber 26 through an intake passage 28 and the inlet valve 20, wherein the mixture is ignited via spark plug 30. The products of combustion are later exhausted through outlet valve 22 and outlet passage 32 on the exhaust stroke (FIG. 4). A connecting rod 34 is pivotally attached at its top distal end 36 to the piston 16. A crankshaft 38 includes a mechanical offset portion called the crankshaft throw 40, which is pivotally attached to the bottom distal end 42 of connecting rod 34. The mechanical linkage of the connecting rod 34 to the piston 16 and crankshaft throw 40 serves to convert the reciprocating motion (as indicated by arrow 44) of the piston 16 to the rotary motion (as indicated by arrow 46) of the crankshaft 38. The crankshaft 38 is mechanically linked (not shown) to an inlet camshaft 48 and an outlet camshaft 50, which precisely control the opening and closing of the inlet valve 20 and outlet valve 22 respectively. The cylinder 14 has a centerline (piston-cylinder axis) 52, which is also the centerline of reciprocation of the piston 16. The crankshaft 38 has a center of rotation (crankshaft axis) 54.

Referring to FIG. 1, with the inlet valve 20 open, the piston 16 first descends (as indicated by the direction of arrow 44) on the intake stroke. A predetermined mass of a flammable mixture of fuel (e.g., gasoline vapor) and air is drawn into the combustion chamber 26 by the partial vacuum thus created. The piston continues to descend until it reaches its bottom dead center (BDC), i.e., the point at which the piston is farthest from the cylinder head 18.

Referring to FIG. 2, with both the inlet 20 and outlet 22 valves closed, the mixture is compressed as the piston 16 ascends (as indicated by the direction of arrow 44) on the compression stroke. As the end of the stroke approaches top dead center (TDC), i.e., the point at which the piston 16 is closest to the cylinder head 18, the volume of the mixture is compressed in this embodiment to one eighth of its initial volume (due to an 8 to 1 Compression Ratio). As the piston approaches TDC, an electric spark is generated across the spark plug (30) gap, which initiates combustion.

Referring to FIG. 3, the power stroke follows with both valves 20 and 22 still closed. The piston 16 is driven downward (as indicated by arrow 44) toward bottom dead center (BDC), due to the expansion of the burning gasses pressing on the crown 24 of the piston 16. The beginning of combustion in conventional engine 10 generally occurs slightly before piston 16 reaches TDC in order to enhance efficiency. When piston 16 reaches TDC, there is a significant clearance volume 60 between the bottom of the cylinder head 18 and the crown 24 of the piston 16.

Referring to FIG. 4, during the exhaust stroke, the ascending piston 16 forces the spent products of combustion through the open outlet (or exhaust) valve 22. The cycle then repeats itself. For this prior art four stroke cycle engine 10, four strokes of each piston 16, i.e. inlet, compression, expansion and exhaust, and two revolutions of the crankshaft 38 are required to complete a cycle, i.e. to provide one power stroke.

Problematically, the overall thermodynamic efficiency of the typical four stroke engine 10 is only about one third (⅓). That is, roughly ⅓ of the fuel energy is delivered to the crankshaft as useful work, ⅓ is lost in waste heat, and ⅓ is lost out of the exhaust. Moreover, with stringent requirements on emissions and the market and legislated need for increased efficiency, engine manufacturers may consider lean-burn technology as a path to increased efficiency. However, as lean-burn is not compatible with the three-way catalyst, the increased $NO_x$ emissions from such an approach must be dealt with in some other way.

Referring to FIG. 5, an alternative to the above described conventional four stroke engine is a split-cycle four stroke engine. The split-cycle engine is disclosed generally in U.S. Pat. No. 6,543,225 to Scuderi, titled Split Four Stroke Internal Combustion Engine, filed on Jul. 20, 2001, which is herein incorporated by reference in its entirety.

An exemplary embodiment of the split-cycle engine concept is shown generally at 70. The split-cycle engine 70 replaces two adjacent cylinders of a conventional four-stroke engine with a combination of one compression cylinder 72 and one expansion cylinder 74. These two cylinders 72, 74 would perform their respective functions once per crankshaft 76 revolution. The intake charge would be drawn into the compression cylinder 72 through typical poppet-style valves 78. The compression cylinder piston 73 would pressurize the charge and drive the charge through the crossover passage 80, which acts as the intake port for the expansion cylinder 74. A check valve 82 at the inlet would be used to prevent reverse flow from the crossover passage 80. Valve(s) 84 at the outlet of the crossover passage 80 would control the flow of the pressurized intake charge into the expansion cylinder 74. Spark plug 86 would be ignited soon after the intake charge enters the expansion cylinder 74, and the resulting combustion would drive the expansion cylinder piston 75 down. Exhaust gases would be pumped out of the expansion cylinder through poppet valves 88.

With the split-cycle engine concept, the geometric engine parameters (i.e., bore, stroke, connecting rod length, Compression Ratio, etc.) of the compression and expansion cylinders are generally independent from one another. For example, the crank throws 90, 92 for each cylinder may have different radii and be phased apart from one another with top dead center (TDC) of the expansion cylinder piston 75 occurring prior to TDC of the compression cylinder piston 73. This independence enables the split-cycle engine to potentially achieve higher efficiency levels than the more typical four stroke engines previously described herein.

However, there are many geometric parameters and combinations of parameters in the split-cycle engine. Therefore, further optimization of these parameters is necessary to maximize the performance of the engine.

Accordingly, there is a need for an improved four stroke internal combustion engine, which can enhance efficiency and reduce $NO_x$ emission levels.

SUMMARY OF THE INVENTION

The present invention offers advantages and alternatives over the prior art by providing a split-cycle engine in which significant parameters are optimized for greater efficiency and performance. The optimized parameters include at least one of Expansion Ratio, Compression Ratio, top dead center phasing, crossover valve duration, and overlap between the crossover valve event and combustion event.

These and other advantages are accomplished in an exemplary embodiment of the invention by providing an engine having a crankshaft, rotating about a crankshaft axis of the engine. An expansion piston is slidably received within an expansion cylinder and operatively connected to the crankshaft such that the expansion piston reciprocates through an expansion stroke and an exhaust stroke of a four stroke cycle during a single rotation of the crankshaft. A compression piston is slidably received within a compression cylinder and operatively connected to the crankshaft such that the compression piston reciprocates through an intake stroke and a compression stroke of the same four stroke cycle during the same rotation of the crankshaft. A ratio of cylinder volumes from BDC to TDC for either one of the expansion cylinder and compression cylinder is substantially 20 to 1 or greater.

In an alternative embodiment of the invention the expansion piston and the compression piston of the engine have a TDC phasing of substantially 50° crank angle or less.

In another alternative embodiment of the invention, an engine includes a crankshaft, rotating about a crankshaft axis of the engine. An expansion piston is slidably received within an expansion cylinder and operatively connected to the crankshaft such that the expansion piston reciprocates through an expansion stroke and an exhaust stroke of a four stroke cycle during a single rotation of the crankshaft. A compression piston is slidably received within a compression cylinder and operatively connected to the crankshaft such that the compression piston reciprocates through an intake stroke and a compression stroke of the same four stroke cycle during the same rotation of the crankshaft. A crossover passage interconnects the compression and expansion cylinders. The crossover passage includes an inlet valve and a crossover valve defining a pressure chamber therebetween. The crossover valve has a crossover valve duration of substantially 69° of crank angle or less.

In still another embodiment of the invention an engine includes a crankshaft, rotating about a crankshaft axis of the engine. An expansion piston is slidably received within an expansion cylinder and operatively connected to the crankshaft such that the expansion piston reciprocates through an expansion stroke and an exhaust stroke of a four stroke cycle during a single rotation of the crankshaft. A compression piston is slidably received within a compression cylinder and operatively connected to the crankshaft such that the compression piston reciprocates through an intake stroke and a compression stroke of the same four stroke cycle during the same rotation of the crankshaft. A crossover passage interconnects the compression and expansion cylinders. The crossover passage includes an inlet valve and a crossover valve defining a pressure chamber therebetween. The crossover valve remains open during at least a portion of a combustion event in the expansion cylinder.

BRIEF DESCRIPTION OF THE DRAWINGS

FIG. 12B is the item definitions of the conventional engine of FIG. 12A;

FIG. 15B is the item definitions of the split-cycle engine of FIG. 15A

DETAILED DESCRIPTION

I. Overview

Figure 2:
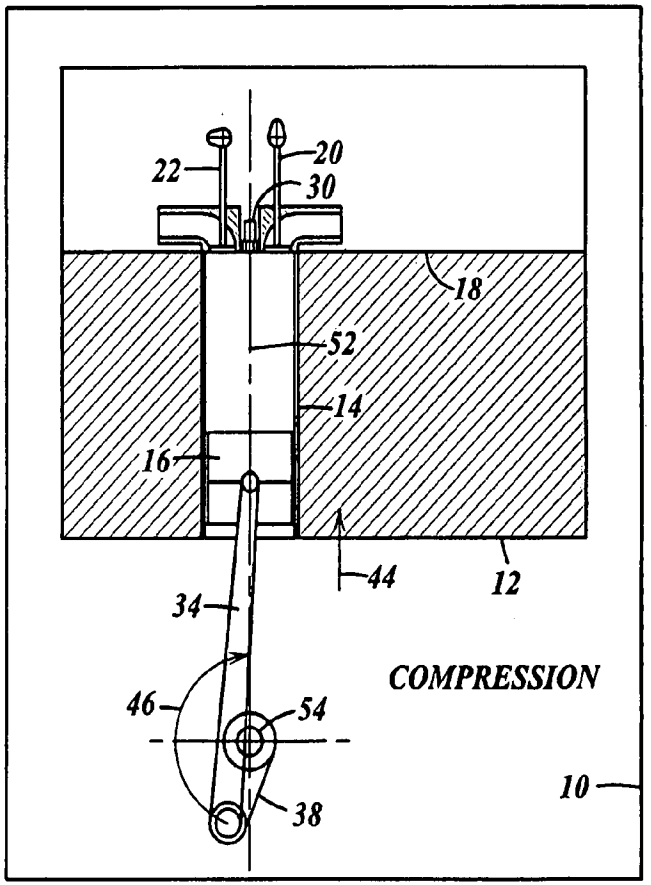
FIG. 2 PRIOR ART
FIG. 2 is a schematic diagram of the prior art engine of FIG. 1 during the compression stroke.
Figure 1:
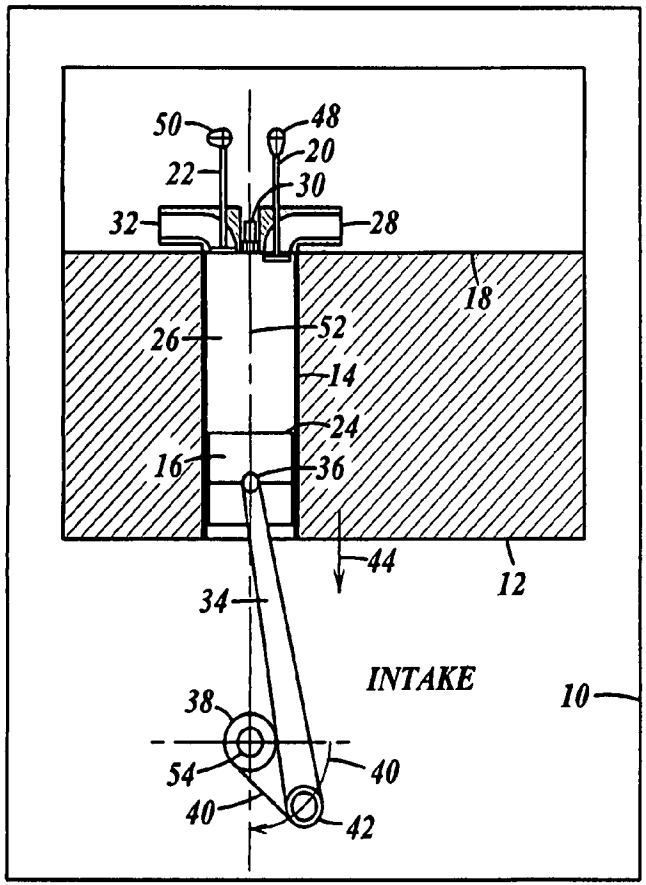
FIG. 1 PRIOR ART
FIG. 1 is a schematic diagram of a prior art conventional four stroke internal combustion engine during the intake stroke.
Figure 4:
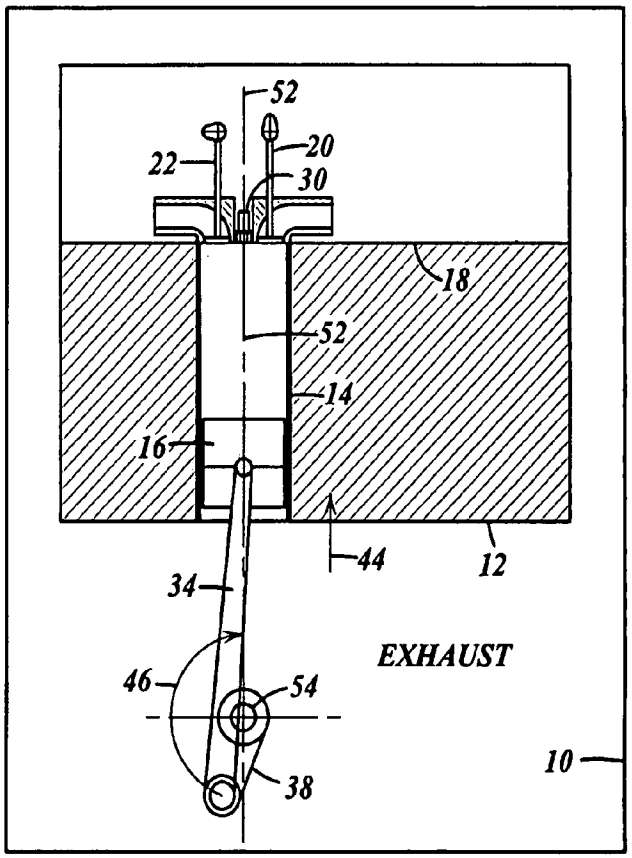
FIG. 4 PRIOR ART
FIG. 4 is a schematic diagram of the prior art engine of FIG. 1 during the exhaust stroke.

The Scuderi Group, LLC commissioned the Southwest Research Institute® (SwRI®) of San Antonio, Tex. to perform a Computerized Study. The Computerized Study involved constructing a computerized model that represented various embodiments of a split-cycle engine, which was compared to a computerized model of a conventional four stroke internal combustion engine having the same trapped mass per cycle. The Study's final report (SwRI® Project No. 03.05932, dated Jun. 24, 2003, titled "Evaluation Of Split-Cycle Four-Stroke Engine Concept") is herein incorporated by reference in its entirety. The Computerized Study resulted in the present invention described herein through exemplary embodiments pertaining to a split-cycle engine.

II. Glossary

The following glossary of acronyms and definitions of terms used herein is provided for reference:

Air/fuel Ratio: proportion of air to fuel in the intake charge

Bottom Dead Center (BDC): the piston's farthest position from the cylinder head, resulting in the largest combustion chamber volume of the cycle.

Brake Mean Effective Pressure (BMEP): the engine's brake torque output expressed in terms of a MEP value. Equal to the brake torque divided by engine displacement.

Brake Power: the power output at the engine output shaft.

Brake Thermal Efficiency (BTE): the prefix "brake": having to do with parameters derived from measured torque at the engine output shaft. This is the performance parameter taken after the losses due to friction. Accordingly BTE=ITE −friction.

Burn Overlap: the percentage of the total combustion event (i.e. from the 0% point to the 100% point of combustion) that is completed by the time of crossover valve closing.

Brake Torque: the torque output at the engine output shaft.

Crank Angle (CA): the angle of rotation of the crankshaft throw, typically referred to its position when aligned with the cylinder bore.

Computational Fluid Dynamics (CFD): a way of solving complex fluid flow problems by breaking the flow regime up into a large number of tiny elements which can then be solved to determine the flow characteristics, the heat transfer and other characteristics relating to the flow solution.

Carbon Monoxide (CO): regulated pollutant, toxic to humans, a product of incomplete oxidation of hydrocarbon fuels.

Combustion Duration: defined for this text as the crank angle interval between the 10% and 90% points from the start of the combustion event. Also known as the Burn Rate. See the Wiebe Heat Release Curve in FIG. 13.

Combustion Event: the process of combusting fuel, typically in the expansion chamber of an engine.

Compression Ratio: ratio of compression cylinder volume at BDC to that at TDC

Crossover Valve Closing (XVC)

Crossover Valve Opening (XVO)

Cylinder Offset: is the linear distance between a bore's centerline and the crankshaft axis.

Displacement Volume: is defined as the volume that the piston displaces from BDC to TDC. Mathematically, if the stroke is defined as the distance from BDC to TDC, then the displacement volume is equal to $\pi/4*\text{bore}^2*\text{stroke}$. Compression Ratio is then the ratio of the combustion chamber volume at BDC to that at TDC. The volume at TDC is referred to as the clearance volume, or $V_{cl}$.

$$V_d=\pi/4*\text{bore}^2*\text{stroke}$$

$$CR=(V_d+V_{cl})/V_{cl}$$

Exhaust Valve Closing (EVC)

Exhaust Valve Opening (EVO)

Expansion Ratio: is the equivalent term to Compression Ratio, but for the expansion cylinder. It is the ratio of cylinder volume at BDC to the cylinder volume at TDC.

Friction Mean Effective Pressure (FMEP): friction level expressed in terms of a MEP. Cannot be determined directly from a cylinder pressure curve though. One common way of measuring this is to calculate the NIMEP from the cylinder pressure curve, calculate the BMEP from the torque measured at the dynamometer, and then assign the difference as friction or FMEP.

Graphical User Interface (GUI)

Indicated Mean Effective Pressure (IMEP): the integration of the area inside the P-dV curve, which also equals the indicated engine torque divided by displacement volume. In fact, all indicated torque and power values are derivatives of this parameter. This value also represents the constant pressure level through the expansion stroke that would provide the same engine output as the actual pressure curve. Can be specified as net indicated (NIMEP) or gross indicated (GIMEP) although when not fully specified, NIMEP is assumed.

Indicated Thermal Efficiency (ITE): the thermal efficiency based on the (net) indicated power.

Intake Valve Closing (IVC)

Intake Valve Opening (IVO)

Mean Effective Pressure: the pressure that would have to be applied to the piston through the expansion stroke to result in the same power output as the actual cycle. This value is also proportional to torque output per displacement.

$NO_x$: various nitrogen oxide chemical species, chiefly NO and $NO_2$. A regulated pollutant and a pre-cursor to smog. Created by exposing an environment including oxygen and nitrogen (i.e. air) to very high temperatures.

Peak Cylinder Pressure (PCP): the maximum pressure achieved inside the combustion chamber during the engine cycle.

Prefixes:—Power, Torque, MEP, Thermal Efficiency and other terms may have the following qualifying prefixes:

Indicated: refers to the output as delivered to the top of the piston, before friction losses are accounted for.

Gross Indicated: refers to the output delivered to the top of the piston, considering only compression and expansion strokes.

Net Indicated: (also the interpretation of "indicated" when not otherwise denoted): refers to the output delivered to the top of the piston considering all four strokes of the cycle: compression, expansion, exhaust, and intake.

Pumping: refers to the output of the engine considering only the intake and exhaust strokes. In this report, positive pumping work refers to work output by the engine while negative relates to work consumed by the engine to perform the exhaust and intake strokes.

From these definitions, it follows that:

Net Indicated=Gross Indicated+Pumping.

Brake=Net Indicated−Friction

Pumping Mean Effective Pressure (PMEP): the indicated MEP associated with just the exhaust and intake strokes. A measure of power consumed in the breathing process. However, sign convention taken is that a positive value means that work is being done on the crankshaft during the pumping loop. (It is possible to get a positive value for PMEP if the engine is turbocharged or otherwise boosted.)

Spark-Ignited (SI): refers to an engine in which the combustion event is initiated by an electrical spark inside the combustion chamber.

Top Dead Center (TDC): the closest position to the cylinder head that the piston reaches throughout the cycle, providing the lowest combustion chamber volume.

TDC Phasing (also referred to herein as the phase angle between the compression and expansion cylinders (see item 172 of FIG. 6)): is the rotational offset, in degrees, between the crank throw for the two cylinders. A zero degree offset would mean that the crank throws were co-linear, while a 180° offset would mean that they were on opposite sides of the crankshaft (i.e. one pin at the top while the other is at the bottom).

Thermal Efficiency: ratio of power output to fuel energy input rate. This value can be specified as brake (BTE) or indicated (ITE) thermal efficiency depending on which power parameter is used in the numerator.

$V_p$: mean piston velocity: the average velocity of the piston throughout the cycle. Can be expressed mathematically as 2*Stroke*Engine Speed.

Valve Duration (or Valve Event Duration): the crank angle interval between a valve opening and a valve closing.

Valve Event: the process of opening and closing a valve to perform a task.

Volumetric Efficiency: the mass of charge (air and fuel) trapped in the cylinder after the intake valve is closed compared to the mass of charge that would fill the cylinder displacement volume at some reference conditions. The reference conditions are normally either ambient, or intake manifold conditions. (The latter is typically used on turbocharged engines.)

Wide-Open Throttle (WOT): refers to the maximum achievable output for a throttled (SI) engine at a given speed.

III. Embodiments of the Split-Cycle Engine Resulting from the Computerized Study Referring to FIGS. 6-11, an exemplary embodiment of a four stroke internal combustion engine in accordance with the present invention is shown generally at 100. The engine 100 includes an engine block 102 having an expansion (or power) cylinder 104 and a compression cylinder 106 extending therethrough. A crankshaft 108 is pivotally connected for rotation about a crankshaft axis 110 (extending perpendicular to the plane of the paper).

The engine block 102 is the main structural member of the engine 100 and extends upward from the crankshaft 108 to the junction with a cylinder head 112. The engine block 102 serves as the structural framework of the engine 100 and typically carries the mounting pad by which the engine is supported in the chassis (not shown). The engine block 102 is generally a casting with appropriate machined surfaces and threaded holes for attaching the cylinder head 112 and other units of the engine 100.

The cylinders 104 and 106 are openings of generally circular cross section, that extend through the upper portion of the engine block 102. The diameter of the cylinders 104 and 106 is known as the bore. The internal walls of cylinders 104 and 106 are bored and polished to form smooth, accurate bearing surfaces sized to receive an expansion (or power) piston 114, and a compression piston 116 respectively.

The expansion piston 114 reciprocates along an expansion piston-cylinder axis 113, and the compression piston 116 reciprocates along a second compression piston-cylinder axis 115. In this embodiment, the expansion and compression cylinders 104 and 106 are offset relative to crankshaft axis 110. That is, the first and second piston-cylinder axes 113 and 115 pass on opposing sides of the crankshaft axis 110 without intersecting the crankshaft axis 110. However, one skilled in the art will recognize that split-cycle engines without offset piston-cylinder axis are also within the scope of this invention.

The pistons 114 and 116 are typically cylindrical castings or forgings of steel or aluminum alloy. The upper closed ends, i.e., tops, of the power and compression pistons 114 and 116 are the first and second crowns 118 and 120 respectively. The outer surfaces of the pistons 114, 116 are generally machined to fit the cylinder bore closely and are typically grooved to receive piston rings (not shown) that seal the gap between the pistons and the cylinder walls.

First and second connecting rods 122 and 124 are pivotally attached at their top ends 126 and 128 to the power and compression pistons 114 and 116 respectively. The crankshaft 108 includes a pair of mechanically offset portions called the first and second throws 130 and 132, which are pivotally attached to the bottom opposing ends 134 and 136 of the first and second connecting rods 122 and 124 respectively. The mechanical linkages of the connecting rods 122 and 124 to the pistons 114, 116 and crankshaft throws 130, 132 serve to convert the reciprocating motion of the pistons (as indicated by directional arrow 138 for the expansion piston 114, and directional arrow 140 for the compression piston 116) to the rotary motion (as indicated by directional arrow 142) of the crankshaft 108.

Though this embodiment shows the first and second pistons 114 and 116 connected directly to crankshaft 108 through connecting rods 122 and 124 respectively, it is within the scope of this invention that other means may also be employed to operatively connect the pistons 114 and 116 to the crankshaft 108. For example a second crankshaft may be used to mechanically link the pistons 114 and 116 to the first crankshaft 108.

The cylinder head 112 includes a gas crossover passage 144 interconnecting the first and second cylinders 104 and 106. The crossover passage includes an inlet check valve 146 disposed in an end portion of the crossover passage 144 proximate the second cylinder 106. A poppet type, outlet crossover valve 150 is also disposed in an opposing end portion of the crossover passage 144 proximate the top of the first cylinder 104. The check valve 146 and crossover valve 150 define a pressure chamber 148 there between. The check valve 146 permits the one way flow of compressed gas from the second cylinder 106 to the pressure chamber 148. The crossover valve 150 permits the flow of compressed gas from the pressure chamber 148 to the first cylinder 104. Though check and poppet type valves are described as the inlet check and the outlet crossover valves 146 and 150 respectively, any valve design appropriate for the application may be used instead, e.g., the inlet valve 146 may also be of the poppet type.

The cylinder head 112 also includes an intake valve 152 of the poppet type disposed over the top of the second cylinder 106, and an exhaust valve 154 of the poppet type disposed over the top to the first cylinder 104. Poppet valves 150, 152 and 154 typically have a metal shaft (or stem) 156 with a disk 158 at one end fitted to block the valve opening. The other end of the shafts 156 of poppet valves 150, 152 and 154 are mechanically linked to camshafts 160, 162 and 164 respectively. The camshafts 160, 162 and 164 are typically a round rod with generally oval shaped lobes located inside the engine block 102 or in the cylinder head 112.

The camshafts 160, 162 and 164 are mechanically connected to the crankshaft 108, typically through a gear wheel, belt or chain links (not shown). When the crankshaft 108 forces the camshafts 160, 162 and 164 to turn, the lobes on the camshafts 160, 162 and 164 cause the valves 150, 152 and 154 to open and close at precise moments in the engine's cycle.

The crown 120 of compression piston 116, the walls of second cylinder 106 and the cylinder head 112 form a compression chamber 166 for the second cylinder 106. The crown 118 of power piston 114, the walls of first cylinder 104 and the cylinder head 112 form a separate combustion chamber 168 for the first cylinder 104. A spark plug 170 is disposed in the cylinder head 112 over the first cylinder 104 and is controlled by a control device (not shown) which precisely times the ignition of the compressed air gas mixture in the combustion chamber 168.

Though this embodiment describes a spark ignition (SI) engine, one skilled in the art would recognize that compression ignition (CI) engines are within the scope of this type of engine also. Additionally, one skilled in the art would recognize that a split-cycle engine in accordance with the present invention can be utilized to run on a variety of fuels other than gasoline, e.g., diesel, hydrogen and natural gas.

During operation the power piston 114 leads the compression piston 116 by a phase angle 172, defined by the degrees of crank angle (CA) rotation the crankshaft 108 must rotate after the power piston 114 has reached its top dead center position in order for the compression piston 116 to reach its respective top dead center position. As will be discussed in the Computer Study hereinafter, in order to maintain advantageous thermal efficiency levels (BTE or ITE), the phase angle 172 is typically set at approximately 20 degrees. Moreover, the phase angle is preferably less than or equal to 50 degrees, more preferably less than or equal to 30 degrees and most preferably less than or equal to 25 degrees.

FIGS. 6-11 represent one full cycle of the split cycle engine 100 as the engine 100 converts the potential energy of a predetermined trapped mass of air/fuel mixture (represented by the dotted section) to rotational mechanical energy. That is, FIGS. 6-11 illustrate intake, partial compression, full compression, start of combustion, expansion and exhaust of the trapped mass respectively. However, it is important to note that engine is fully charged with air/fuel mixture throughout, and that for each trapped mass of air/fuel mixture taken in and compressed through the compression cylinder 106, a substantially equal trapped mass is combusted and exhausted through the expansion cylinder 104.

Figure 6:
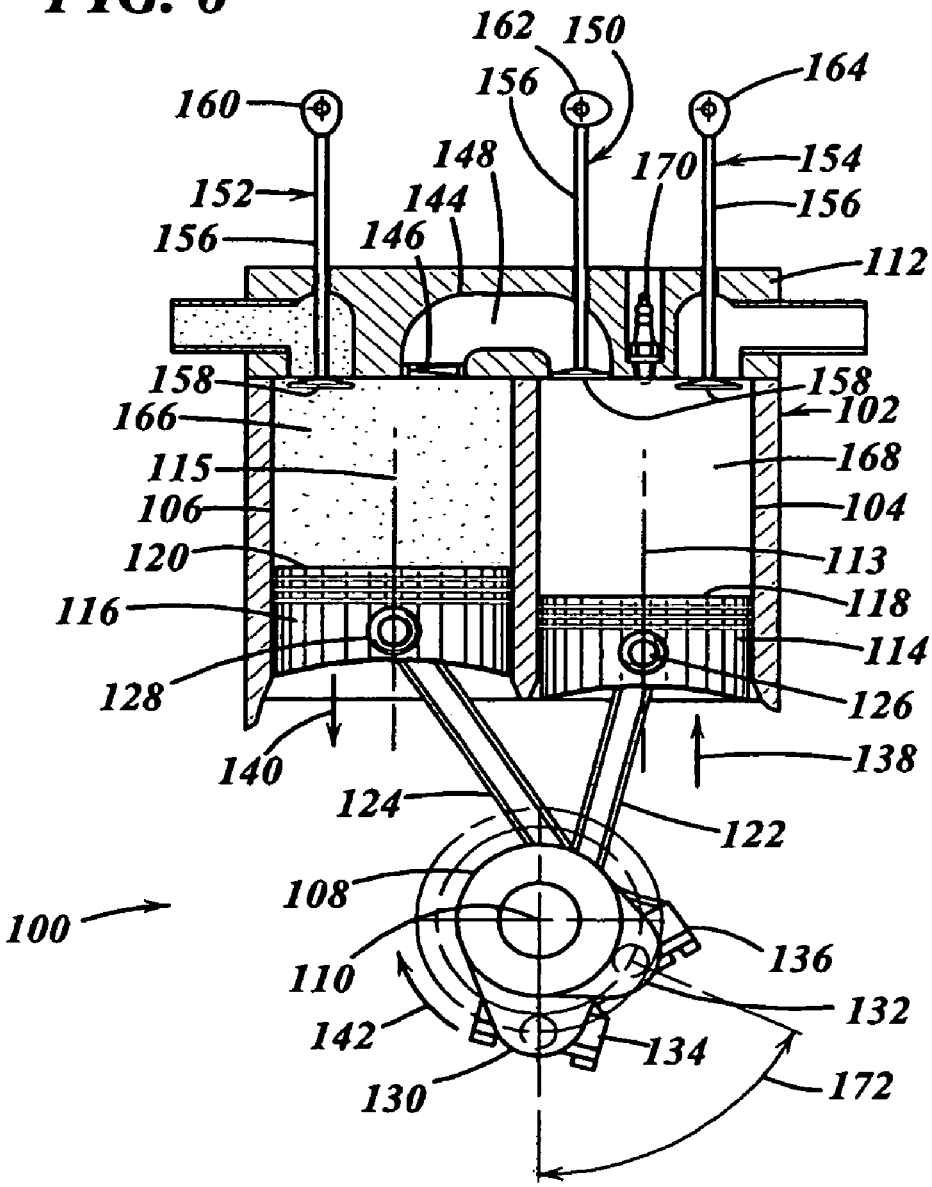
FIG. 6 is a schematic diagram of an exemplary embodiment of a split-cycle four stroke internal combustion engine in accordance with the present invention during the intake stroke.

FIG. 6 illustrates the power piston 114 when it has reached its bottom dead center (BDC) position and has just started ascending (as indicated by arrow 138) into its exhaust stroke. Compression piston 116 is lagging the power piston 114 and is descending (arrow 140) through its intake stroke. The inlet valve 152 is open to allow a predetermined volume of explosive mixture of fuel and air to be drawn into the compression chamber 166 and be trapped therein (i.e., the trapped mass as indicated by the dots on FIG. 6). The exhaust valve 154 is also open allowing piston 114 to force spent products of combustion out of the combustion chamber 168.

The check valve 146 and crossover valve 150 of the crossover passage 144 are closed to prevent the transfer of ignitable fuel and spent combustion products between the two chambers 166 and 168. Additionally during the exhaust and intake strokes, the check valve 146 and crossover valve 150 seal the pressure chamber 148 to substantially maintain the pressure of any gas trapped therein from the previous compression and power strokes.

Figure 7:
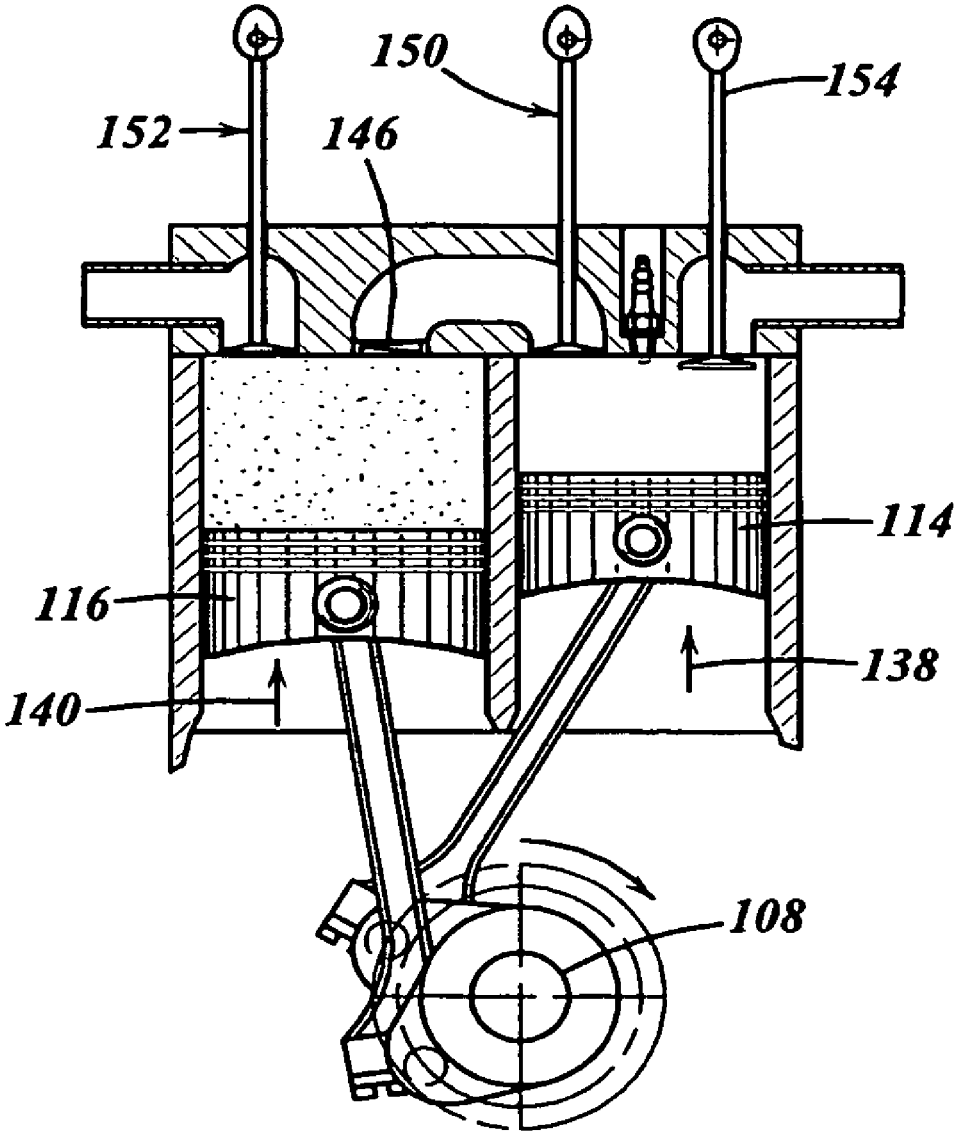
FIG. 7 is a schematic diagram of the split-cycle engine of FIG. 6 during partial compression of the compression stroke.

Referring to FIG. 7, partial compression of the trapped mass is in progress. That is inlet valve 152 is closed and compression piston 116 is ascending (arrow 140) toward its top dead center (TDC) position to compress the air/fuel mixture. Simultaneously, exhaust valve 154 is open and the expansion piston 114 is also ascending (arrow 138) to exhaust spent fuel products.

Figure 8:
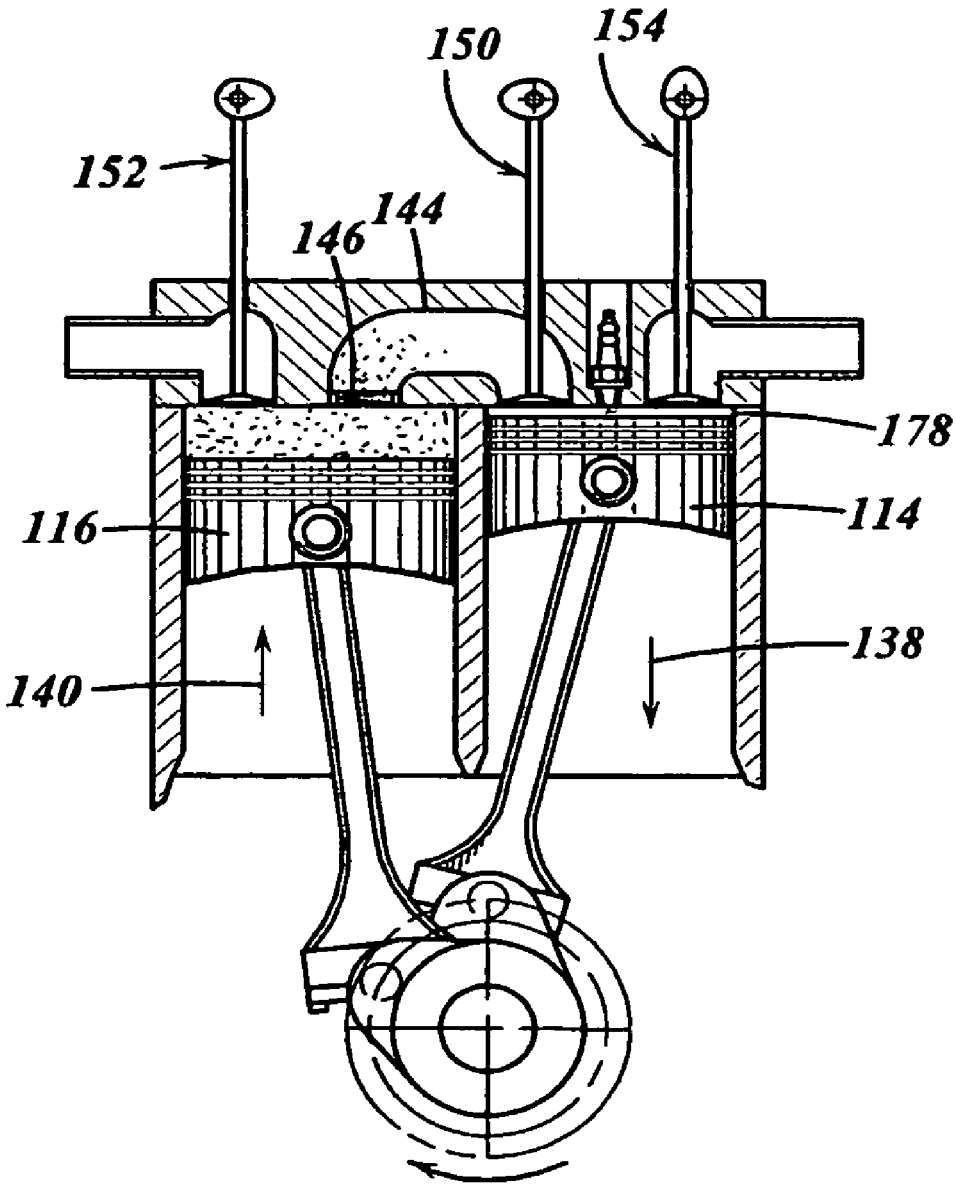
FIG. 8 is a schematic diagram of the split-cycle engine of FIG. 6 during full compression of the compression stroke.

Referring to FIG. 8, the trapped mass (dots) is further compressed and is beginning to enter the crossover passage 144 through check valve 146. The expansion piston 114 has reached its top dead center (TDC) position and is about to descend into its expansion stroke (indicated by arrow 138), while the compression piston 116 is still ascending through its compression stroke (indicated by arrow 140). At this point, check valve 146 is partially open. The crossover outlet valve 150, intake valve 152 and exhaust valve 154 are all closed.

Figure 3:
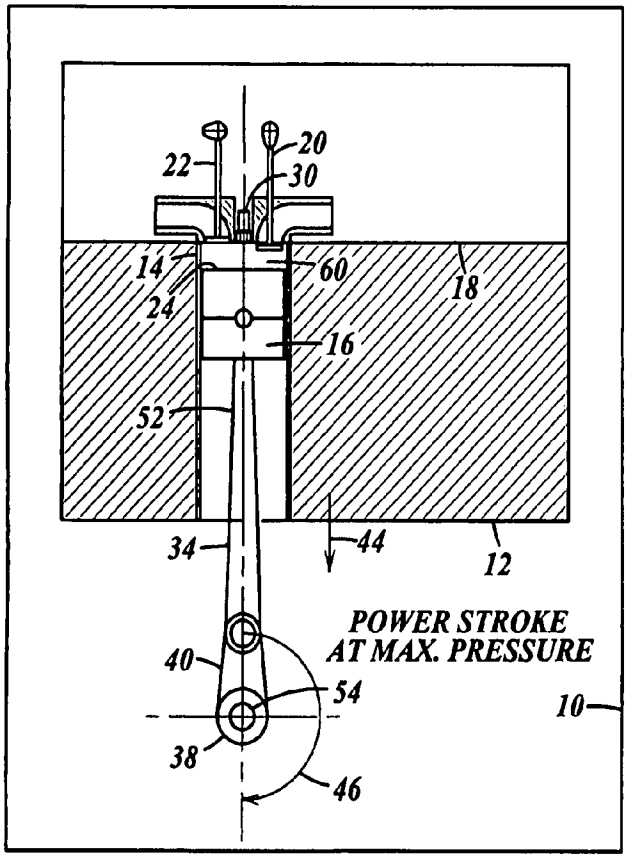
FIG. 3 PRIOR ART
FIG. 3 is a schematic diagram of the prior art engine of FIG. 1 during the expansion stroke.
Figure 5:
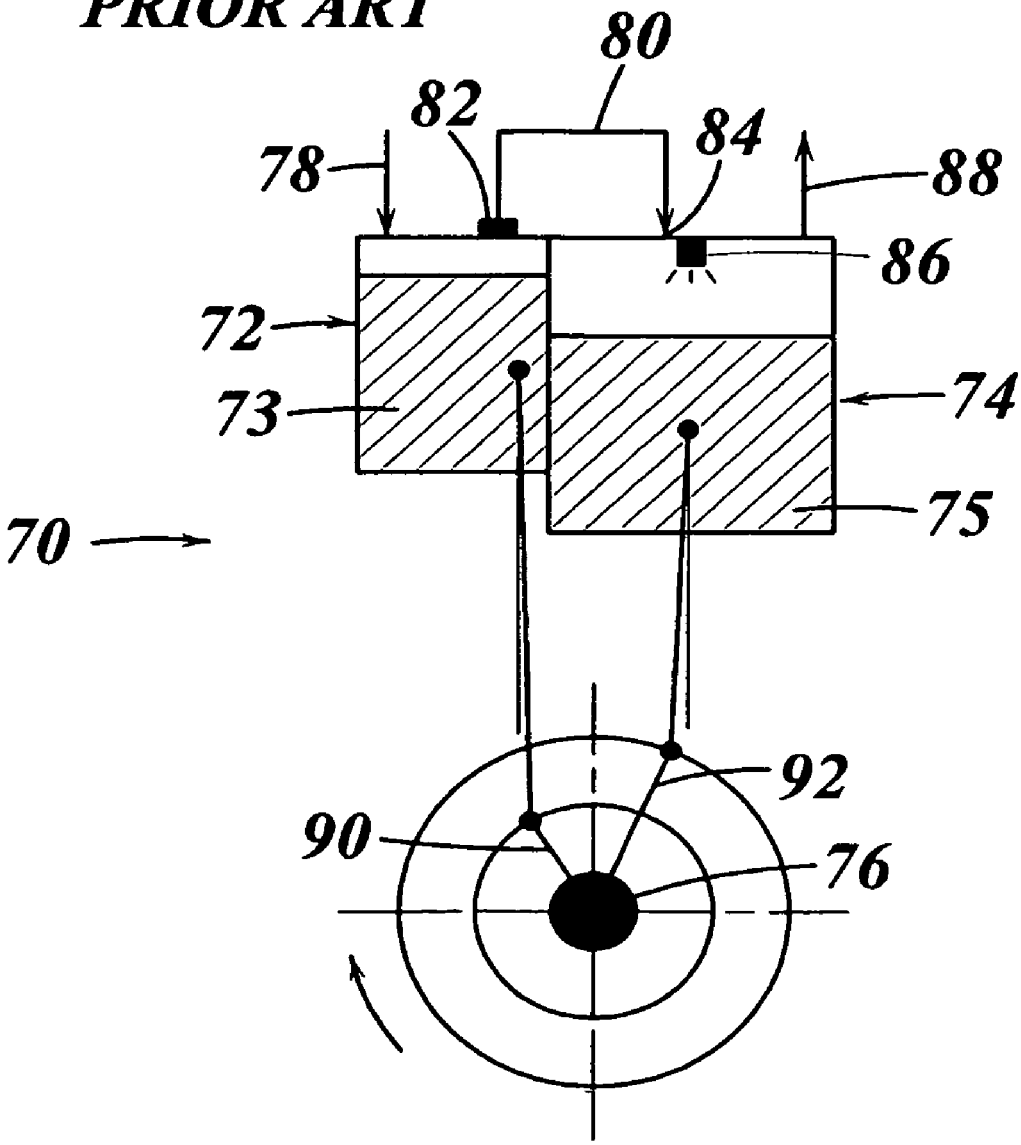
FIG. 5 PRIOR ART
FIG. 5 is a schematic diagram of a prior art split-cycle four stroke internal combustion engine.

At TDC piston 114 has a clearance distance 178 between the crown 118 of the piston 114 and the top of the cylinder 104. This clearance distance 178 is very small by comparison to the clearance distance 60 of a conventional engine 10 (best seen in prior art FIG. 3). This is because the clearance (or Compression Ratio) on the conventional engine is limited to avoid inadvertent compression ignition and excessive cylinder pressure. Moreover, by reducing the clearance distance 178, a more thorough flushing of the exhaust products is accomplished.

The ratio of the expansion cylinder volume (i.e., combustion chamber 168) when the piston 114 is at BDC to the expansion cylinder volume when the piston is at TDC is defined herein as the Expansion Ratio. This ratio is generally much higher than the ratio of cylinder volumes between BDC and TDC of the conventional engine 10. As indicated in the following Computer Study description, in order to maintain advantageous efficiency levels, the Expansion Ratio is typically set at approximately 120 to 1. Moreover, the Expansion Ratio is preferably equal to or greater than 20 to 1, more preferably equal to or greater than 40 to 1, and most preferably equal to or greater than 80 to 1.

Figure 9:
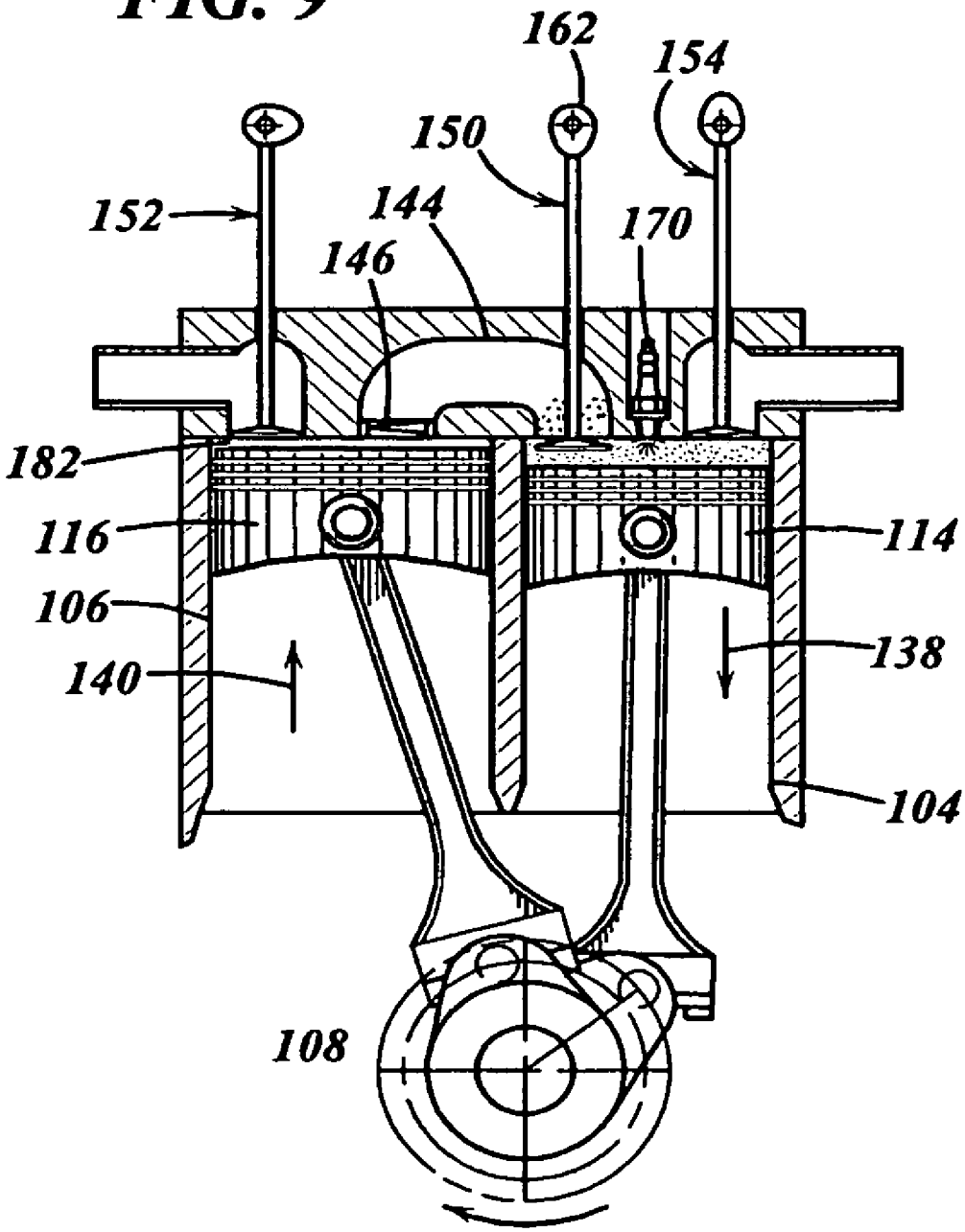
FIG. 9 is a schematic diagram of the split-cycle engine of FIG. 6 during the start of the combustion event.

Referring to FIG. 9, the start of combustion of the trapped mass (dotted section) is illustrated. The crankshaft 108 has rotated an additional predetermined number of degrees past the TDC position of expansion piston 114 to reach its firing position. At this point, spark plug 170 is ignited and combustion is started. The compression piston 116 is just completing its compression stroke and is close to its TDC position. During this rotation, the compressed gas within the compression cylinder 116 reaches a threshold pressure which forces the check valve 146 to fully open, while cam 162 is timed to also open crossover valve 150. Therefore, as the power piston 114 descends and the compression piston 116 ascends, a substantially equal mass of compressed gas is transferred from the compression chamber 166 of the compression cylinder 106 to the combustion chamber 168 of the expansion cylinder 104.

As noted in the following Computer Study description, it is advantageous that the valve duration of crossover valve 150, i.e., the crank angle interval (CA) between the crossover valve opening (XVO) and crossover valve closing (XVC), be very small compared to the valve duration of the intake valve 152 and exhaust valve 154. A typical valve duration for valves 152 and 154 is typically in excess of 160 degrees CA. In order to maintain advantageous efficiency levels, the crossover valve duration is typically set at approximately 25 degrees CA. Moreover, the crossover valve duration is preferably equal to or less than 69 degrees CA, more preferably equal to or less than 50 degrees CA, and most preferably equal to or less than 35 degrees CA.

Additionally, the Computer Study also indicated that if the crossover valve duration and the combustion duration overlapped by a predetermined minimum percentage of combustion duration, then the combustion duration would be substantially decreased (that is the burn rate of the trapped mass would be substantially increased). Specifically, the crossover valve 150 should remain open preferably for at least 5% of the total combustion event (i.e. from the 0% point to the 100% point of combustion) prior to crossover valve closing, more preferably for 10% of the total combustion event, and most preferably for 15% of the total combustion event. As explained in greater detail hereinafter, the longer the crossover valve 150 can remain open during the time the air/fuel mixture is combusting (i.e., the combustion event), the greater the increase in burn rate and efficiency levels will be. Limitations to this overlap will be discussed in later sections.

Upon further rotation of the crankshaft 108, the compression piston 116 will pass through to its TDC position and thereafter start another intake stroke to begin the cycle over again. The compression piston 116 also has a very small clearance distance 182 relative to the standard engine 10. This is possible because, as the gas pressure in the compression chamber 166 of the compression cylinder 106 reaches the pressure in the pressure chamber 148, the check valve 146 is forced open to allow gas to flow through. Therefore, a very small volume of high pressure gas is trapped at the top of the compression piston 116 when it reaches its TDC position.

The ratio of the compression cylinder volume (i.e., compression chamber 166) when the piston 116 is at BDC to the compression cylinder volume when the piston is at TDC is defined herein as the Compression Ratio. This ratio is generally much higher than the ratio of cylinder volumes between BDC and TDC of the conventional engine 10. As indicated in the following Computer Study description, in order to maintain advantageous efficiency levels, the Compression Ratio is typically set at approximately 100 to 1. Moreover, the Compression Ratio is preferably equal to or greater than 20 to 1, more preferably equal to or greater than 40 to 1, and most preferably equal to or greater than 80 to 1.

Figure 10:
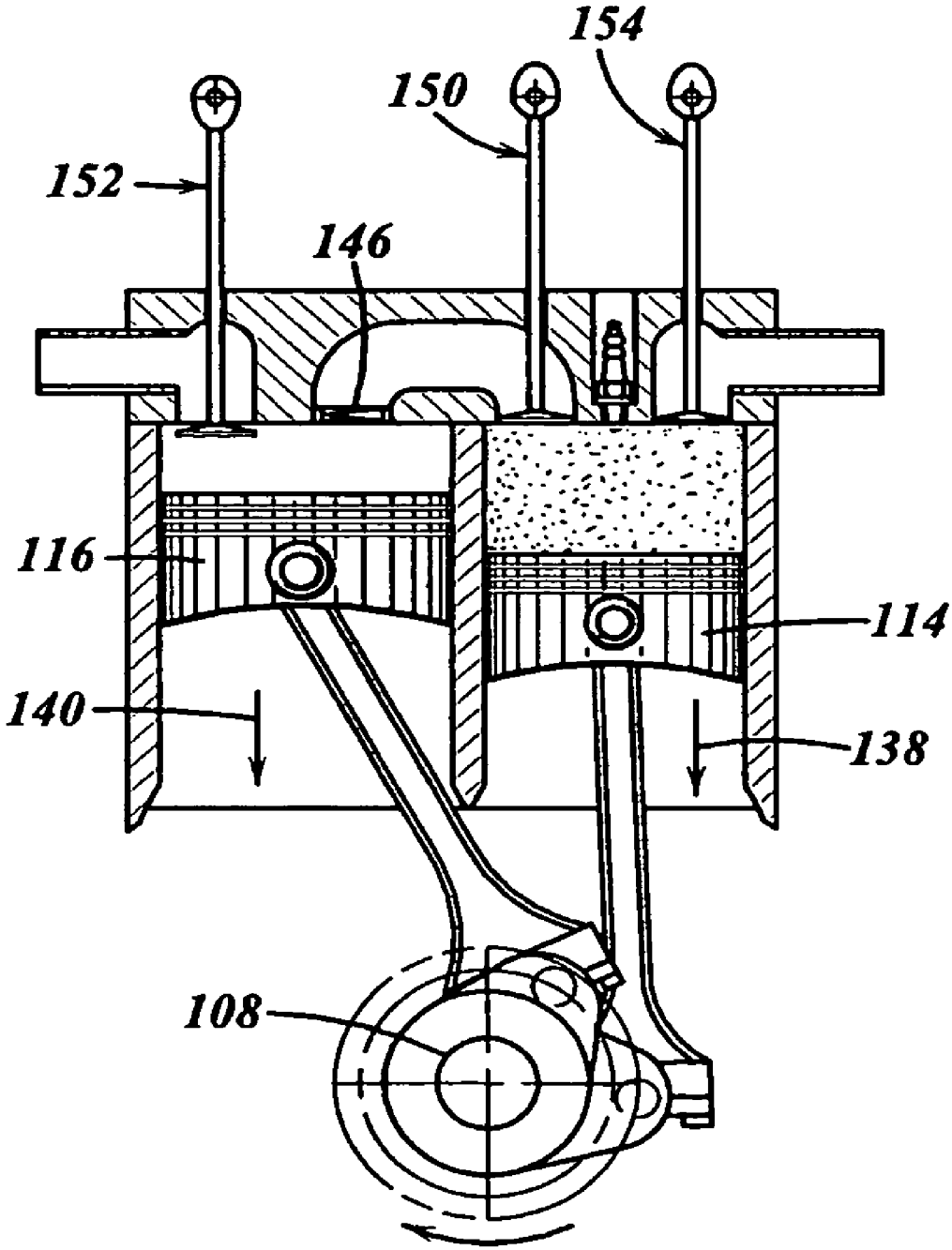
FIG. 10 is a schematic diagram of the split-cycle engine of FIG. 6 during the expansion stroke.

Referring to FIG. 10, the expansion stroke on the trapped mass is illustrated. As the air/fuel mixture is combusted, the hot gases drive the expansion piston 114 down.

Figure 11:
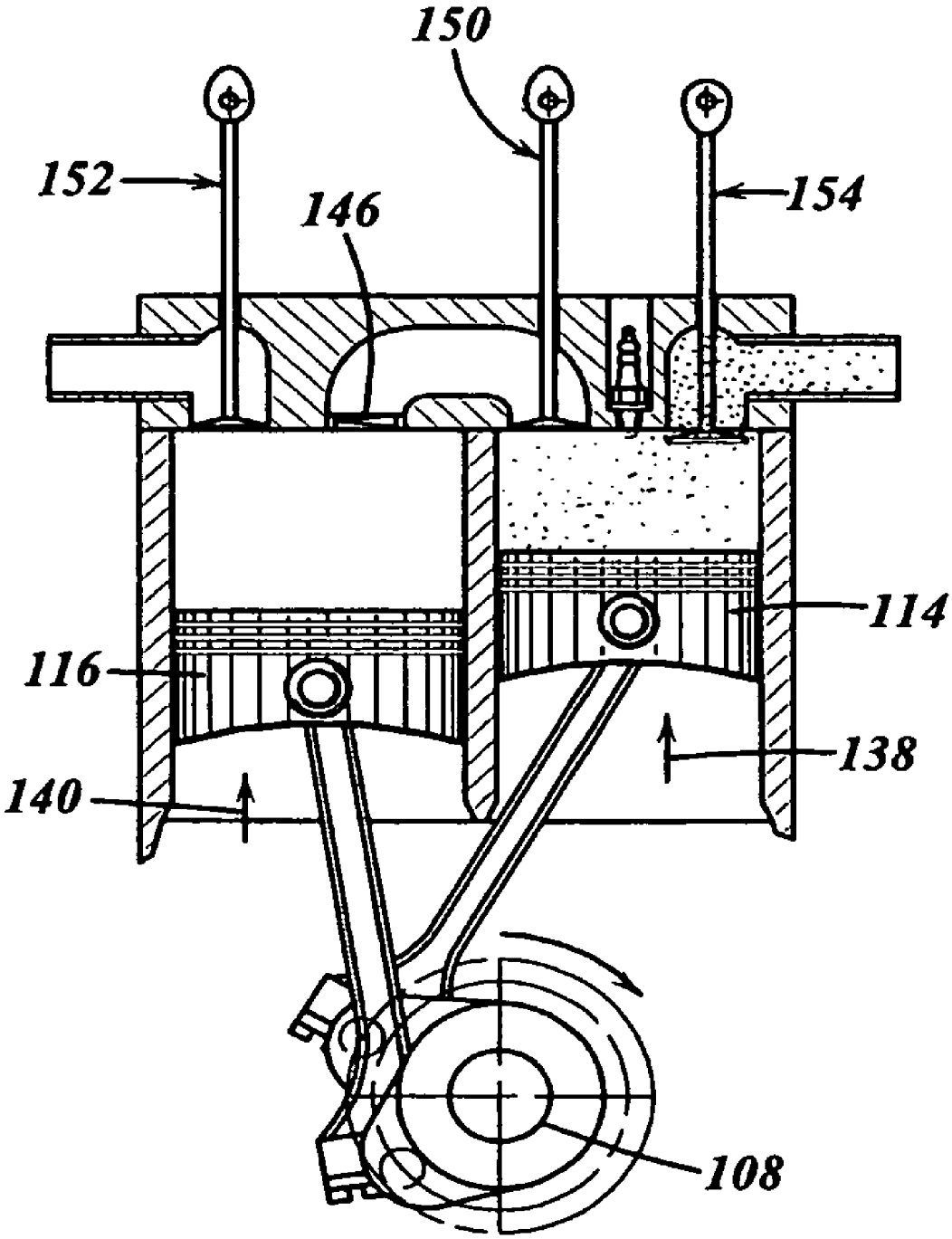
FIG. 11 is a schematic diagram of the split-cycle engine of FIG. 6 during the exhaust stroke.

Referring to FIG. 11, the exhaust stroke on the trapped mass is illustrated. As the expansion cylinder reaches BDC and begins to ascend again, the combustion gases are exhausted out the open valve 154 to begin another cycle.

IV. Computerized Study

1.0 Summary of Results

1.1. Advantages

The primary objective of the Computerized Study was to study the concept split-cycle engine, identify the parameters exerting the most significant influence on performance and efficiency, and determine the theoretical benefits, advantages, or disadvantages compared to a conventional four-stroke engine.

The Computerized Study identified Compression Ratio, Expansion Ratio, TDC phasing (i.e., the phase angle between the compression and expansion pistons (see item 172 of FIG. 6)), crossover valve duration and combustion duration as significant variables affecting engine performance and efficiency. Specifically the parameters were set as follows:

- the compression and Expansion Ratios should be equal to or greater than 20 to 1 and were set at 100 to 1 and 120 to 1 respectively for this Study;
- the phase angle should be less than or equal to 50 degrees and was set at approximately 20 degrees for this study; and
- the crossover valve duration should be less than or equal to 69 degrees and was set at approximately 25 degrees for this Study.

Moreover, the crossover valve duration and the combustion duration should overlap by a predetermined percent of the combustion event for enhanced efficiency levels. For this Study, CFD calculations showed that an overlap of 5% of the total combustion event was realistic and that greater overlaps are achievable with 35% forming the unachievable upper limit for the embodiments modeled in this study.

When the parameters are applied in the proper configuration the split-cycle engine displayed significant advantages in both brake thermal efficiency (BTE) and $NO_x$ emissions. Table 9 summarized the results of the Computerized Study with regards to BTE, and FIG. 24 graphs the predicted $NO_x$ emissions, for both the conventional engine model and various embodiments of the split-cycle engine model.

The predicted potential gains for the split-cycle engine concept at the 1400 rpm engine speed are in the range of 0.7 to less than 5.0 points (or percentage points) of brake thermal efficiency (BTE) as compared to that of a conventional four stroke engine at 33.2 points BTE. In other words, the BTE of the split-cycle engine was calculated to be potentially between 33.9 and 38.2 points.

The term "point" as used herein, refers to the absolute calculated or measured value of percent BTE out of a theoretically possible 100 percentage points. The term "percent", as used herein, refers to the relative comparative difference between the calculated BTE of the split-cycle engine and the base line conventional engine. Accordingly, the range of 0.7 to less than 5.0 points increase in BTE for the split-cycle engine represents a range of approximately 2 (i.e., 0.7/33.2) to less than 15 (5/33.2) percent increase in BTE over the baseline of 33.2 for a conventional four stroke engine.

Additionally, the Computerized Study also showed that if the split-cycle engine were constructed with ceramic expansion piston and cylinder, the BTE may potentially further increase by as much as 2 more points, i.e., 40.2 percentage points BTE, which represents an approximate 21 percent increase over the conventional engine. One must keep in mind however, that ceramic pistons and cylinders have durability problems with long term use; in addition, this approach would further aggravate the lubrication issues with the even higher temperature cylinder walls that would result from the use of these materials.

With the stringent requirements on emissions and the market need for increased efficiency, many engine manufacturers struggle to reduce $NO_x$ emissions while operating at lean air/fuel ratios. An output of a CFD combustion analysis performed during the Computer Study indicated that the split-cycle engine could potentially reduce the $NO_x$ emissions levels of the conventional engine by 50% to 80% when comparing both engines at a lean air/fuel ratio.

The reduction in $NO_x$ emissions could potentially be significant both in terms of its impact on the environment as well as the efficiency of the engine. It is a well known fact that efficiencies can be improved on SI engines by running lean (significantly above 14.5 to 1 air/fuel ratio). However, the dependence on three way catalytic converters (TWC), which require a stoichiometric exhaust stream in order to reach required emissions levels, typically precludes this option on production engines. (Stoichiometric air/fuel ratio is about 14.5 for gasoline fuel.) The lower $NO_x$ emissions of the split-cycle engine may allow the split-cycle to run lean and achieve additional efficiency gains on the order of one point (i.e., approximately 3%) over a conventional engine with a conventional TWC. TWCs on conventional engines demonstrate $NO_x$ reduction levels of above 95%, so the split-cycle engine cannot reach their current post-TWC levels, but depending on the application and with the use of other after treatment technology, the split-cycle engine may be able to meet required $NO_x$ levels while running at lean air/fuel ratios.

These results have not been correlated to experimental data, and emissions predictions from numerical models tend to be highly dependent on tracking of trace species through the combustion event. If these results were confirmed on an actual test engine, they would constitute a significant advantage of the split-cycle engine concept.

1.2 Risks And Suggested Solutions

The Computerized Study also identified the following risks associated with the split-cycle engine:

- Sustained elevated temperatures in the expansion cylinder could lead to thermal-structural failures of components and problems with lube oil retention,
- Possible valve train durability issues with crossover valve due to high acceleration loads,
- Valve-to-piston interference in the expansion cylinder, and
- Auto-ignition and/or flame propagation into crossover passage.

However, the above listed risks may be addressed through a myriad of possible solutions. Examples of potential technologies or solutions that may be utilized are given below.

Dealing with the sustained high temperatures in the expansion cylinder may utilize unique materials and/or construction techniques for the cylinder wall. In addition, lower temperature and/or different coolants may need to be used. Also of concern in dealing with the high temperatures is the lubrication issue. Possible technologies for overcoming this challenge are extreme high temperature-capable liquid lubricants (advanced synthetics) as well as solid lubricants.

Addressing the second item of valve train loads for the very quick-acting crossover valve may include some of the technology currently being used in advanced high speed racing engines such as pneumatic valve springs and/or low inertia, titanium valves with multiple mechanical springs per valve. Also, as the design moves forward into detailed design, the number of valves will be reconsidered, as it is easier to move a larger number of smaller valves more quickly and they provide a larger total circumference providing better flow at low lift.

The third item of crossover valve interference with the piston near TDC may be addressed by recessing the crossover valves in the head, providing reliefs or valve cutouts in the piston top to allow space for the valve(s), or by designing an outward-opening crossover valve.

The last challenge listed is auto-ignition and/or flame propagation into the crossover passage. Auto-ignition in the crossover passage refers to the self-ignition of the air/fuel mixture as it resides in the crossover passage between cycles due to the presence of a combustible mixture held for a relatively long duration at high temperature and pressure. This can be addressed by using port fuel injection, where only air resides in the crossover passage between cycles therefore preventing auto-ignition. The fuel is then added either directly into the cylinder, or to the exit end of the crossover passage, timed to correspond with the crossover valve opening time.

The second half of this issue, flame propagation into the crossover passage, can be further optimized with development. That is, although it is very reasonable to design the timing of the split-cycle engine's crossover valve to be open during a small portion of the combustion event, e.g., 5% or less, the longer the crossover valve is open during the combustion event the greater the positive impact on thermal efficiency that can be achieved in this engine. However, this direction of increased overlap between the crossover valve and combustion events increases the likelihood of flame propagation into the cross-over passage. Accordingly, effort can be directed towards understanding the relationship between combustion timing, spark plug location, crossover valve overlap and piston motion in regards to the avoidance of flame propagation into the crossover passage.

2.0 Conventional Engine Model

A cycle simulation model was constructed of a two-cylinder conventional naturally-aspirated four-stroke SI engine and analyzed using a commercially available software package called GT-Power, owned by Gamma Technologies, Inc. of Westmont, Ill. The characteristics of this model were tuned using representative engine parameters to yield performance and efficiency values typical of naturally-aspirated gasoline SI engines. The results from these modeling efforts were used to establish a baseline of comparison for the split-cycle engine concept.

2.1 GT-Power Overview

Figure 12A:
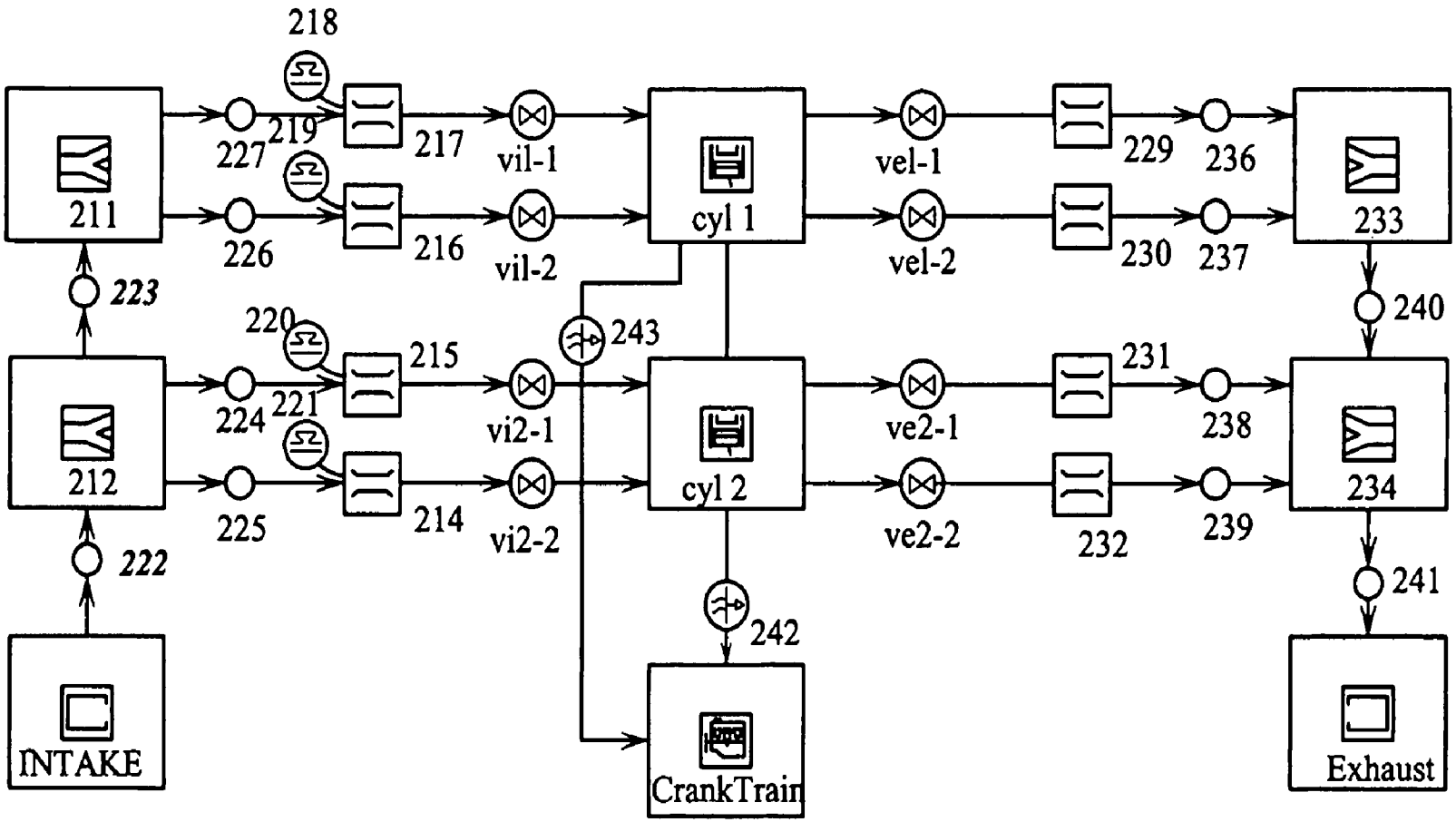
FIG. 12A is a schematic diagram of a GT-Power graphical user interface for a conventional engine computer model used in a comparative Computerized Study.

GT-Power is a 1-d computational fluids-solver that is commonly used in industry for conducting engine simulations. GT-Power is specifically designed for steady state and transient engine simulations. It is applicable to all types of internal combustion engines, and it provides the user with several menu-based objects to model the many different components that can be used on internal combustion engines. FIG. 12A shows the GT-Power graphical user interface (GUI) for the two-cylinder conventional engine model.

Referring to FIGS. 12A and B, Intake air flows from the ambient source into the intake manifold, represented by junctions 211 and 212. From there, the intake air enters the intake ports (214-217) where fuel is injected and mixed with the airstream. At the appropriate time of the cycle, the intake valves (vix-y) open while the pistons in their respective cylinders (cyl1 and cyl2) are on their downstroke (intake stroke). The air and fuel mixture are admitted into the cylinder during this stroke, after which time the intake valves close. (Cyl 1 and cyl 2 are not necessarily in phase; i.e. they may go through the intake process at completely different times.) After the intake stroke, the piston rises and compresses the mixture to a high temperature and pressure. Near the end of the compression stroke, the spark plug is energized which begins the burning of the air/fuel mixture. It burns, further raising the temperature and pressure of the mixture and pushing down on the piston through the expansion or power stroke. Near the end of the expansion stroke, the exhaust valve opens and the piston begins to rise, pushing the exhaust out of the cylinder into the exhaust ports (229-232). From the exhaust ports, the exhaust is transmitted into the exhaust manifold (233-234) and from there to the end environment (exhaust) representing the ambient.

2.2 Conventional Engine Model Construction

The engine characteristics were selected to be representative of typical gasoline SI engines. The engine displacement was similar to a two-cylinder version of an automotive application in-line four-cylinder 202 $in^3$ (3.3 L) engine. The Compression Ratio was set to 8.0:1. The stoichiometric air/fuel ratio for gasoline, which defines the proportions of air and fuel required to convert all of the fuel into completely oxidized products with no excess air, is approximately 14.5:1. The selected air/fuel ratio of 18:1 results in lean operation. Typical automotive gasoline SI engines operate at stoichiometric or slightly rich conditions at full load. However, lean operation typically results in increased thermal efficiency.

The typical gasoline SI engine runs at stoichiometric conditions because that is a requirement for proper operation of the three-way catalytic converter. The three-way catalyst (TWC) is so-named due to its ability to provide both the oxidation of HC and CO to $H_2O$ and $CO_2$, as well as the reduction of $NO_x$ to $N_2$ and $O_2$. These TWCs are extremely effective, achieving reductions of over 90% of the incoming pollutant stream but require close adherence to stoichiometric operation. It is a well known fact that efficiencies can be improved on SI engines by running lean, but the dependence on TWCs to reach required emissions levels typically precludes this option on production engines.

It should be noted that under lean operation, oxidation catalysts are readily available which will oxidize HC and CO, but reduction of $NO_x$ is a major challenge under such conditions. Developments in the diesel engine realm have recently included the introduction of lean $NO_x$ traps and lean $NO_x$ catalysts. At this point, these have other drawbacks such as poor reduction efficiency and/or the need for periodic regeneration, but are currently the focus of a large amount of development.

In any case, the major focus of the Computerized Study is the relative efficiency and performance. Comparing both engines (split-cycle and conventional) at 18:1 air/fuel ratio provides comparable results. Either engine could be operated instead under stoichiometric conditions such that a TWC would function and both would likely incur similar performance penalties, such that the relative results of this study would still stand. The conventional engine parameters are listed in Table 1.

TABLE 1

Conventional Engine Parameters

| Parameter | Value |
|---|---|
| Bore | 4.0 in (101.6 mm) |
| Stroke | 4.0 in (101.6 mm) |
| Connecting Rod Length | 9.6 in (243.8 mm) |
| Crank Throw | 2.0 in (50.8 mm) |
| Displacement Volume | 50.265 $in^3$ (0.824 L) |
| Clearance Volume | 7.180 $in^3$ (0.118 L) |
| Compression Ratio | 8.0:1 |
| Engine Speed | 1400 rpm |
| Air/Fuel Ratio | 18:1 |

Initially, the engine speed was set at 1400 rpm. This speed was to be used throughout the project for the parametric sweeps. However, at various stages of the model construction, speed sweeps were conducted at 1400, 1800, 2400, and 3000 rpm.

The clearance between the top of the piston and the cylinder head was initially recommended to be 0.040 in (1 mm). To meet this requirement with the 7.180 $in^3$ (0.118 L) clearance volume would require a bowl-in-piston combustion chamber, which is uncommon for automotive SI engines. More often, automotive SI engines feature pent-roof combustion chambers. SwRI® assumed a flat-top piston and cylinder head to simplify the GT-Power model, resulting in a clearance of 0.571 in (14.3 mm) to meet the clearance volume requirement. There was a penalty in brake thermal efficiency (BTE) of 0.6 points with the larger piston-to-head clearance.

The model assumes a four-valve cylinder head with two 1.260 in (32 mm) diameter intake valves and two 1.102 in (28 mm) diameter exhaust valves. The intake and exhaust ports were modeled as straight sections of pipe with all flow losses accounted for at the valve. Flow coefficients at maximum list were approximately 0.57 for both the intake and exhaust, which were taken from actual flow test results from a representative engine cylinder head. Flow coefficients are used to quantify the flow performance of intake and exhaust ports on engines. A 1.0 value would indicate a perfect port with no flow losses. Typical maximum lift values for real engine ports are in the 0.5 to 0.6 range.

Intake and exhaust manifolds were created as 2.0 in (50.8 mm) diameter pipes with no flow losses. There was no throttle modeled in the induction system since the focus is on wide-open throttle (WOT), or full load, operation. The fuel is delivered via multi-port fuel injection.

The valve events were taken from an existing engine and scaled to yield realistic performance across the speed range (1400, 1800, 2400 and 3000 rpm), specifically volumetric efficiency. Table 2 lists the valve events for the conventional engine.

TABLE 2

Conventional Engine Breathing and Combustion Parameters

| Parameter | Value | |
|---|---|---|
| Intake Valve Opening (IVO) | 28° BTDC-breathing | 332° ATDC-firing |
| Intake Valve Closing (IVC) | 17° ABDC | 557° ATDC-firing |
| Peak Intake Valve Lift | 0.412 in (10.47 mm) | |
| Exhaust Valve Opening (EVO) | 53° BBDC | 127° ATDC-firing |
| Exhaust Valve Closing (EVC) | 37° ATDC-breathing | 397° ATDC-firing |
| Peak Exhaust Valve Lift | 0.362 in (9.18 mm) | |
| 50% Burn Point | 10° ATDC-firing | 10° ATDC-firing |
| Combustion Duration (10-90%) | 24° crank angle (CA) | |

The combustion process was modeled using an empirical Wiebe heat release, where the 50% burn point and 10 to 90% burn duration were fixed user inputs. The 50% burn point provides a more direct means of phasing the combustion event, as there is no need to track spark timing and ignition delay. The 10 to 90% burn duration is the crank angle interval required to burn the bulk of the charge, and is the common term for defining the duration of the combustion event. The output of the Wiebe combustion model is a realistic non-instantaneous heat release curve, which is then used to calculate cylinder pressure as a function of crank angle (CA).

The Wiebe function is an industry standard for an empirical heat release correlation, meaning that it is based on previous history of typical heat release profiles. It provides an equation, based on a few user-input terms, which can be easily scaled and phased to provide a reasonable heat release profile.

Figure 13:
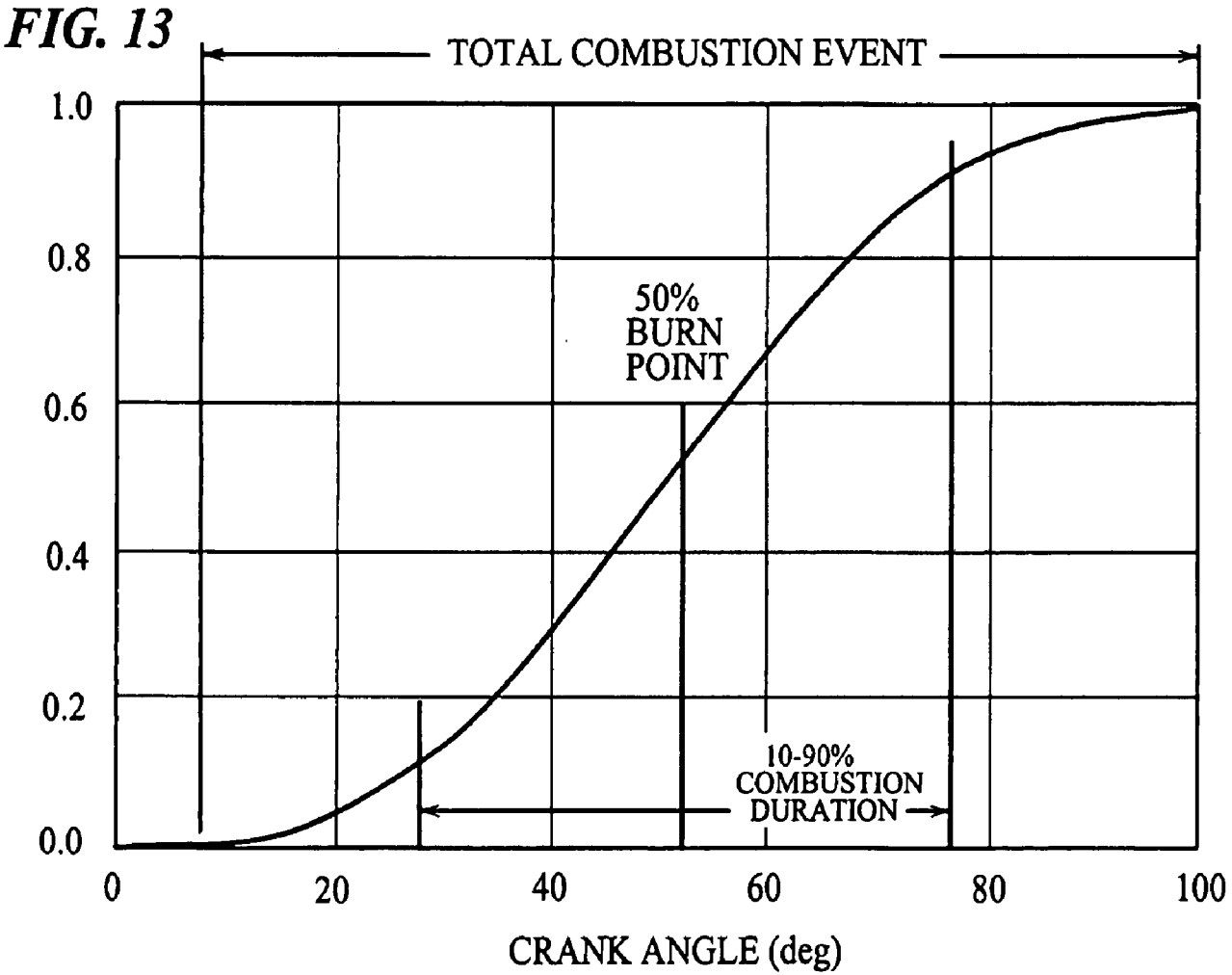
FIG. 13 is a typical Wiebe heat release curve.

FIG. 13 shows a typical Wiebe heat release curve with some of the key parameters denoted. As shown, the tails of the heat release profile (<10% burn and >90% burn) are quite long, but do not have a strong effect on performance due to the small amount of heat released. At the same time, the actual start and end are difficult to ascertain due to their asymptotic approach to the 0 and 100% burn lines. This is especially true with respect to test data, where the heat release curve is a calculated profile based on the measured cylinder pressure curve and other parameters. Therefore, the 10 and 90% burn points are used to represent the nominal "ends" of the heat release curve. In the Wiebe correlation, the user specifies the duration of the 10-90% burn period (i.e. 10-90% duration) and that controls the resultant rate of heat release. The user can also specify the crank angle location of some other point on the profile, most typically either the 10 or 50% point, as an anchor to provide the phasing of the heat release curve relative to the engine cycle.

The wall temperature solver in GT-Power was used to predict the piston, cylinder head, and cylinder liner wall temperatures for the conventional engine. GT-Power is continuously calculating the heat transfer rates from the working fluid to the walls of each passage or component (including cylinders). This calculation needs to have the wall temperature as a boundary condition. This can either be provided as a fixed input, or the wall temperature solver can be turned on to calculate it from other inputs. In the latter case, wall thickness and material are specified so that wall conductivity can be determined. In addition, the bulk fluid temperature that the backside of the wall is exposed to is provided, along with the convective heat transfer coefficient. From these inputs, the program solves for the wall temperature profile which is a function of the temperature and velocity of the working fluid, among other things. The approach used in this work was that the wall temperature solver was turned on to solve for realistic temperatures for the cylinder components and then those temperatures were assigned to those components as fixed temperatures for the remaining runs.

Cylinder head coolant was applied at 200 F (366 K) with a heat transfer coefficient of 3000 $W/m^2$–K. The underside of the piston is splash-cooled with oil applied at 250 F (394 K) with a heat transfer coefficient of 5 $W/m^2$–K. The cylinder walls are cooled via coolant applied at 200 F (366 K) with a heat transfer coefficient of 500 $W/m^2$–K and oil applied at 250 F (394 K) with a heat transfer coefficient of 1000 $W/m^2$–K. These thermal boundary conditions were applied to the model to predict the in-cylinder component surface temperatures. The predicted temperatures were averaged across the speed range and applied as fixed wall temperatures in the remaining simulations. Fixed surface temperatures for the piston 464 F (513 K), cylinder head 448 F (504 K), and liner 392 F (473 K) were used to model the heat transfer between the combustion gas and in-cylinder components for the remaining studies.

The engine friction was characterized within GT-Power using the Chen-Flynn correlation, which is an experiment-based empirical relationship relating cylinder pressure and mean piston speed to total engine friction. The coefficients used in the Chen-Flynn correlation were adjusted to give realistic friction values across the speed range.

2.3 Summary of Results of the Conventional Engine

Table 3 summarizes the performance results for the two-cylinder conventional four-stroke engine model. The results are listed in terms of indicated torque, indicated power, indicated mean effective pressure (IMEP), indicated thermal efficiency (ITE), pumping mean effective pressure (PMEP), friction mean effective pressure (FMEP), brake torque, brake power, brake mean effective pressure (BMEP), brake thermal efficiency (BTE), volumetric efficiency, and peak cylinder pressure. For reference, mean effective pressure is defined as the work per cycle divided by the volume displaced per cycle.

TABLE 3

| Parameter | 1400 rpm | 1800 rpm | 2400 rpm | 3000 rpm |
|---|---|---|---|---|
| Summary of Predicted Conventional Engine Performance (English Units) | | | | |
| Indicated Torque (ft-lb) | 90.6 | 92.4 | 93.4 | 90.7 |
| Indicated Power (hp) | 24.2 | 31.7 | 42.7 | 51.8 |
| Net IMEP (psi) | 135.9 | 138.5 | 140.1 | 136.1 |
| ITE (%) | 37.5 | 37.9 | 38.2 | 38.0 |
| PMEP (psi) | −0.6 | −1.2 | −2.4 | −4.0 |
| FMEP (psi) | 15.5 | 17.5 | 20.5 | 23.5 |
| Brake Torque (ft-lb) | 80.3 | 80.7 | 79.7 | 75.1 |
| Brake Power (hp) | 21.4 | 27.7 | 36.4 | 42.9 |
| BMEP (psi) | 120.4 | 121.0 | 119.6 | 112.6 |
| BTE (%) | 33.2 | 33.1 | 32.6 | 31.5 |
| Vol. Eff. (%) | 88.4 | 89.0 | 89.5 | 87.2 |
| Peak Cylinder Pressure (psi) | 595 | 600 | 605 | 592 |
| Summary of Predicted Conventional Engine Performance (SI Units) | | | | |
| Indicated Torque (N-m) | 122.9 | 125.2 | 126.7 | 123.0 |
| Indicated Power (kW) | 18.0 | 23.6 | 31.8 | 38.6 |
| Net IMEP (Bar) | 9.4 | 9.6 | 9.7 | 9.4 |
| ITE (%) | 37.5 | 37.9 | 38.2 | 38.0 |
| PMEP (bar) | −0.04 | −0.08 | −0.17 | −0.28 |

TABLE 3-continued

| Parameter | 1400 rpm | 1800 rpm | 2400 rpm | 3000 rpm |
|---|---|---|---|---|
| FMEP (Bar) | 1.07 | 1.21 | 1.42 | 1.62 |
| Brake Torque (N-m) | 108.9 | 109.4 | 108.1 | 101.8 |
| Brake Power (Kw) | 16.0 | 20.6 | 27.2 | 32.0 |
| BMEP (bar) | 8.3 | 8.3 | 8.2 | 7.8 |
| BTE (%) | 33.2 | 33.1 | 32.6 | 31.5 |
| Vol. Eff. (%) | 88.4 | 89.0 | 89.5 | 87.2 |
| Peak Cylinder Pressure (bar) | 41.0 | 41.4 | 41.74 | 40.8 |

Figure 14:
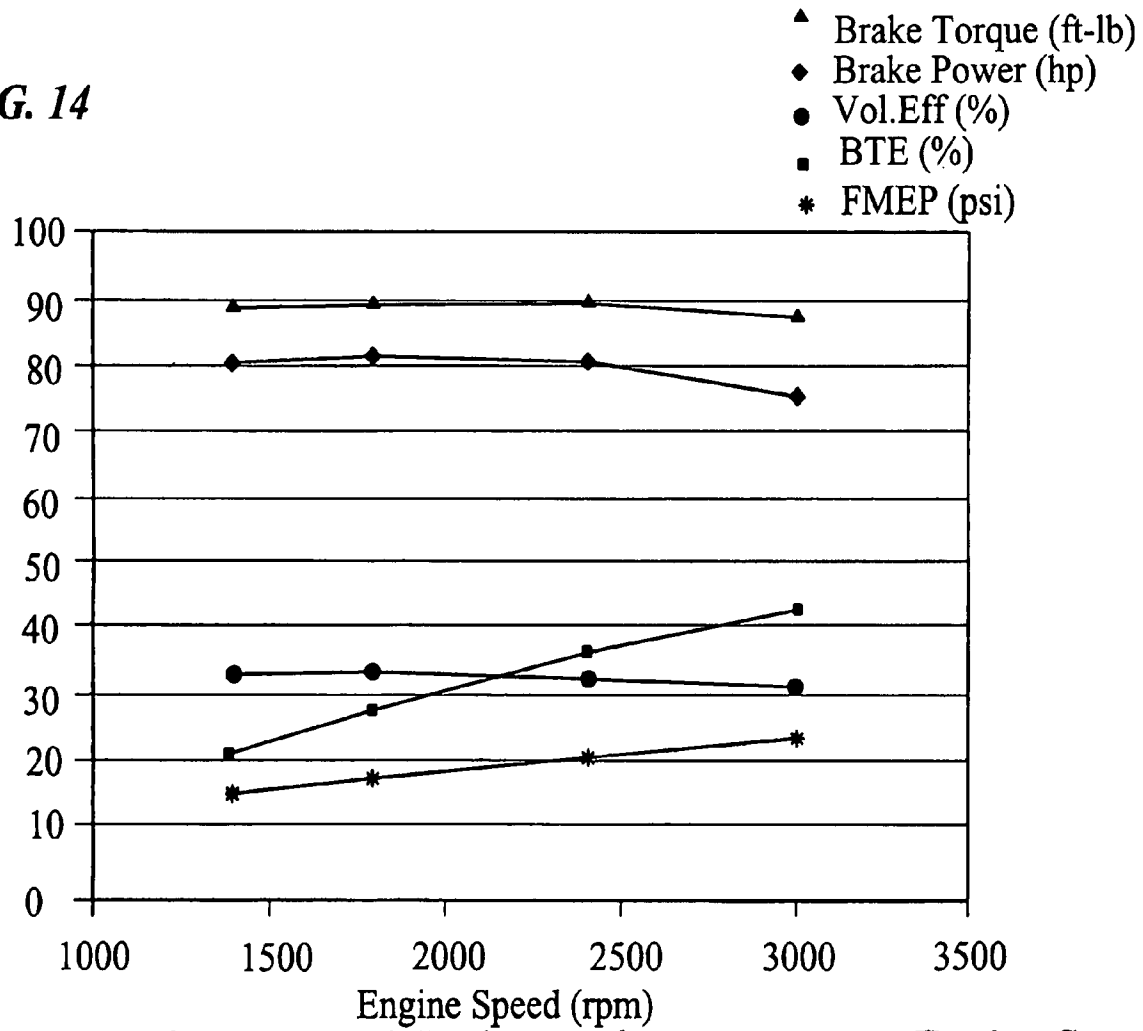
FIG. 14 is a graph of performance parameters of the conventional engine of FIG. 12A.

Referring to FIG. 14 performance is plotted in terms of brake torque, brake power, BMEP, volumetric efficiency, FMEP, and brake thermal efficiency across the speed range. The valve events were initially set using measured lift profiles from an existing engine. The timing and duration of the intake and exhaust valves events were tuned to yield representative volumetric efficiency values across the speed range. As shown in FIG. 14, the volumetric efficiency is approximately 90% across the speed range, but began to drop off slightly at 3000 rpm. Similarly, the brake torque values were fairly flat across the speed range, but tailed off slightly at 3000 rpm. The shape of the torque curve resulted in a near linear power curve. The trend of brake thermal efficiency across the speed range was fairly consistent. There was a range of 1.7 points of thermal efficiency from the maximum at 1400 rpm of 33.2% to the minimum at 3000 rpm of 31.5%.

3.0 Split-Cycle Engine Model

A model of the split-cycle concept was created in GT-Power based on the engine parameters provided by the Scuderi Group, LLC. The geometric parameters of the compression and expansion cylinders were unique from one another and quite a bit different from the conventional engine. The validity of comparison against the conventional engine results was maintained by matching the trapped mass of the intake charge. That is, the split-cycle engine was made to have the same mass trapped in the compression cylinder after intake valve closure as the conventional; this was the basis of the comparison. Typically, equivalent displacement volume is used to insure a fair comparison between engines, but it is very difficult to define the displacement of the split-cycle engine; thus equivalent trapped mass was used as the basis.

3.1 Initial Split-Cycle Model

Several modifications were made to the split-cycle engine model. It was found that some of the most significant parameters were the TDC phasing and compression and Expansion Ratios. The modified engine parameters were summarized in Tables 4 and 5

TABLE 4

Split-Cycle Engine Parameters (Compression Cylinder)

| Parameter | Value |
|---|---|
| Bore | 4.410 in (112.0 mm) |
| Stroke | 4.023 in (102.2 mm) |
| Connecting Rod Length | 9.6 in (243.8 mm) |
| Crank Throw | 2.011 in (51.1 mm) |
| Displacement Volume | 61.447 $in^3$ (1.007 L) |
| Clearance Volume | 0.621 $in^3$ (0.010 L) |
| Compression Ratio | 100:1 |
| Cylinder Offset | 1.00 in (25.4 mm) |
| TDC Phasing | 25 CA |
| Engine Speed | 1400 rpm |
| Air/Fuel Ratio | 18:1 |

TABLE 5

Split-Cycle Engine Parameters (Expansion Cylinder)

| Parameter | Value |
|---|---|
| Bore | 4.000 in (101.6 mm) |
| Stroke | 5.557 in (141.1 mm) |
| Connecting Rod Length | 9.25 in (235.0 mm) |
| Crank Throw | 2.75 in (70.0 mm) |
| Displacement Volume | 69.831 $in^3$ (1.144 L) |
| Clearance Volume | 0.587 $in^3$ (0.010 L) |
| Expansion Ratio | 120:1 |
| Cylinder Offset | 1.15 in (29.2 mm) |

Figure 15A:
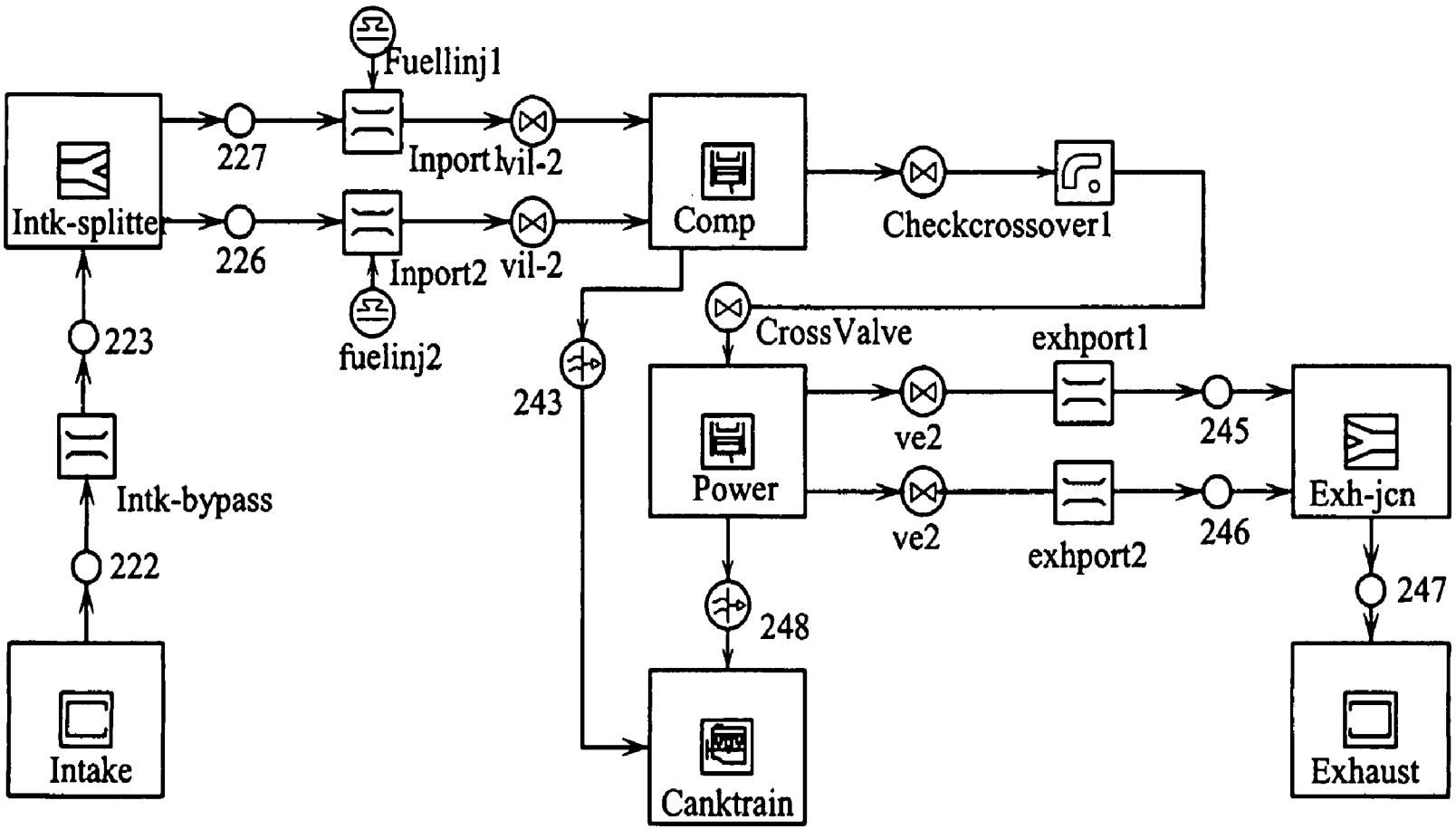
FIG. 15A is a schematic diagram of a GT-Power graphical user interface for a split-cycle engine computer model in accordance with the present invention and used in the Computerized Study.

Referring to FIGS. 15A and B, the GT-Power GUI for the split-cycle engine model is shown. Intake air flows from the ambient source into the intake manifold, represented by pipe intk-bypass and junction intk-splitter. From there, the intake air enters the intake ports (intport1, intport2) where fuel is injected and mixed with the airstream. At the appropriate time of the cycle, the intake valves (vi1-*y*) open while the piston in cylinder comp is on its downstroke (intake stroke). The air and fuel mixture are admitted into the cylinder during this stroke, after which time the intake valves close. After the intake stroke, the piston rises and compresses the mixture to a high temperature and pressure. Near the end of the compression stroke, the pressure is sufficient to open the check valve (check) and push air/fuel mixture into the crossover passage. At this same time, the power cylinder has just completed the exhaust stroke and passed TDC. At approximately this time, the crossover valve (cross valve) opens and admits air from the crossover passage and from the comp cylinder, whose piston is approaching TDC. At approximately the time of the comp cylinder's piston TDC (i.e. after power cylinder's piston TDC by the phase angle offset), the crossover valve closes and the spark plug is energized in the power cylinder. The mixture burns, further raising the temperature and pressure of the mixture and pushing down on the power piston through the expansion or power stroke. Near the end of the expansion stroke, the exhaust valve opens and the piston begins to rise, pushing the exhaust out of the cylinder via the exhaust valves (ve1, ve2) into the exhaust ports (exhport1, exhport2). Note that the compression and exhaust strokes as well as the intake and power strokes are taking place at roughly the same time but on different cylinders. From the exhaust ports, the exhaust is transmitted into the exhaust manifold (exh-jcn) and from there to the end environment (exhaust) representing the ambient.

Note that the layout of the model is very similar to the conventional engine model. The intake and exhaust ports and valves, as well as the multi-port fuel injectors, were taken directly from the conventional engine model. The crossover passage was modeled as a curved constant diameter pipe with one check valve at the inlet and poppet valves at the exit. In the initial configuration, the crossover passage was 1.024 in (26.0 mm) diameter, with four 0.512 in (13.0 mm) valves at the exit. The poppet valves feeding the expansion cylinder were referred to as the crossover valves.

Though the crossover passage was modeled as a curved constant diameter pipe having a check valve inlet and poppet valve outlet, one skilled in the art would recognize that other configurations of the above are within the scope of this invention. For example, the crossover passage may include a fuel injection system, or the inlet valve may be a poppet valve rather than a check valve. Moreover various well known variable valve timing systems may be utilized on either of the crossover valve or the inlet valve to the crossover passage.

Figure 16:
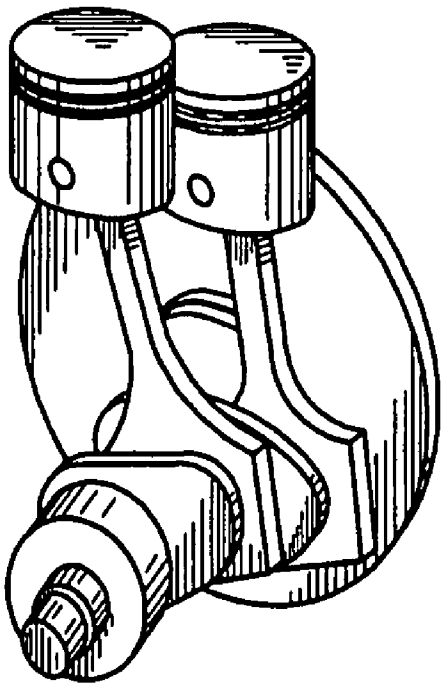
FIG. 16 is a schematic representation of an MSC.ADAMS® model diagram of the split cycle engine of FIG. 15A.

Referring to FIG. 16, a model of the split-cycle engine was constructed using an MSC.ADAMS® dynamic analysis software package to confirm the piston motion profiles and produce an animation of the mechanism. MSC.ADAMS® software, owned by MSC.Software Corporation of Santa Ana, Calif., is one of the most widely used dynamics simulation software packages in the engine industry. It is used to calculate forces and vibrations associated with moving parts in general. One application is to generate motions, velocities, and inertial forces and vibrations in engine systems. FIG. 16 shows a schematic representation of the MSC.ADAMS® model.

Once the split-cycle engine model was producing positive work, there were several other refinements made. The timing of the intake valve opening (IVO) and exhaust valve closing (EVC) events were adjusted to find the best trade-off between valve timing and clearance volume as limited by valve-to-position interference. These events were investigated during the initial split-cycle modeling efforts and optimum IVO and EVC timings were set. IVO was retarded slightly to allow for the compression piston to receive some expansion work from the high gas pressure remaining after feeding the crossover passage. This precluded the trade-off between reducing clearance volume and early IVO for improved breathing. The engine breathed well, and the late IVO allowed the piston to recover a bit of expansion work.

EVC was advanced to produce a slight pressure build-up prior to crossover valve opening (XVO). This helped reduce the irreversible loss from dumping the high-pressure gas from the crossover chamber into a large volume low-pressure reservoir.

The Wiebe combustion model was used to calculate the heat release for the split-cycle engine. Table 6 summarizes the valve events and combustion parameters, referenced to TDC of the expansion piston, with the exception of the intake valve events, which are referenced to TDC of the compression piston.

TABLE 6

Split-Cycle Engine Breathing and Combustion Parameters

| Parameter | Value | All referenced to TDC of power cylinder |
|---|---|---|
| Intake Valve Opening (IVO) | 17° ATDC (comp) | 42° ATDC |
| Intake Valve Closing (IVC) | 174° BTDC (comp) | 211° ATDC |
| Peak Intake Valve Lift | 0.412 in (10.47 mm) | |
| Exhaust Valve Opening (EVO) | 134° ATDC (power) | 134° ATDC |
| Exhaust Valve Closing (EVC) | 2° BTDC (power) | 358° ATDC |
| Peak Exhaust Valve Lift | 0.362 in (9.18 mm) | |
| Crossover Valve Opening (XVO) | 5° BTDC (power) | 355° ATDC |
| Crossover Valve Closing (XVC) | 25° ATDC (power) | 25° ATDC |
| Peak Crossover Valve Lift | 0.089 in (2.27 mm) | |
| 50% Burn Point | 37° ATDC (power) | 37° ATDC |
| Combustion Duration (10-90%) | 24° CA | |

Figure 17:
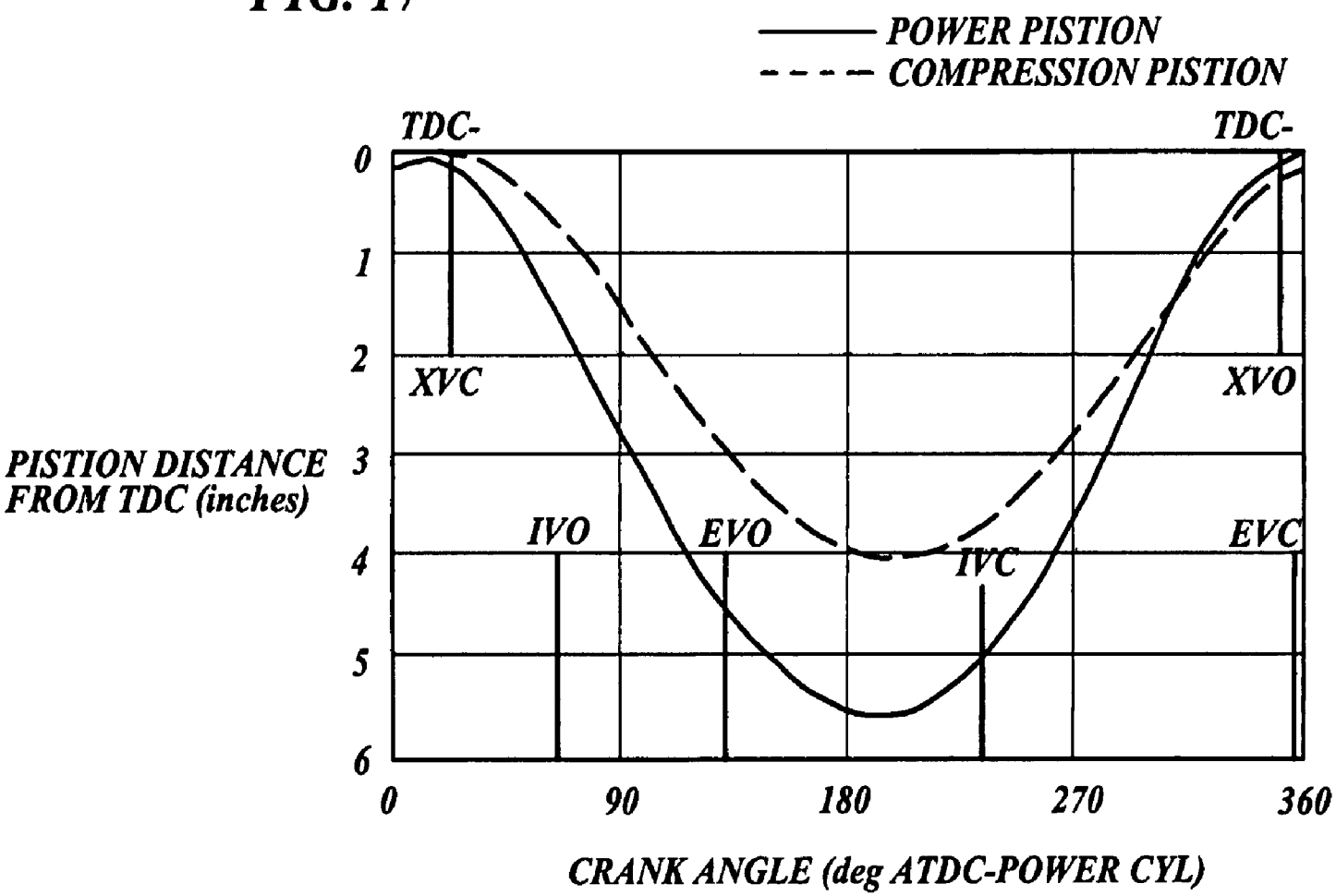
FIG. 17 is a graph of the compression and expansion piston positions and valve events for the split-cycle engine of FIG. 15A.

Additionally, FIG. 17 provides a graph of the compression and expansion piston positions, and valve events for the split-cycle engine.

One of the first steps was to check the clearance between the crossover valve and power cylinder piston. The crossover valve is open when the expansion cylinder piston is at TDC, and the piston-to-head clearance is 0.040 in (1.0 mm). There was interference indicating valve-to-piston contact. Attempts were made to fix the problem by adjusting the phasing of the crossover valve, but this resulted in a 1 to 2 point penalty in indicated thermal efficiency (ITE) across the speed range. The trade-offs were discussed and it was decided that it would be better to alleviate the interference and return to the previous phasing, thus retaining the higher ITE values. Possible solutions to be considered include valve reliefs in the piston crown, recessing the valves in the cylinder head, or outward opening valves.

Next, the number of crossover valves was reduced from four to two, with the valves sized to match the cross-sectional area of the crossover passage outlet. For the 1.024 in (26. mm) diameter crossover passage outlet, this resulted in two 0.724 in (18.4 mm) valves as compared to four 0.512 in (13.0 mm) valves. This change was made to simplify the crossover valve mechanism and make the expansion side cylinder head more like a typical cylinder head with two intake valves.

The wall temperature solver in GT-Power was used to predict the piston, cylinder head, and cylinder liner wall temperatures for both the conventional and split-cycle engines. Originally, it was assumed that aluminum pistons would be used for both the conventional and split-cycle engines. The predicted piston temperatures for both the conventional engine and split-cycle compression cylinder piston were well within standards limits, but the split-cycle power cylinder piston was approximately 266 F (130 C) over the limit. To address this concern, the power cylinder piston was changed to a one-piece steel oil-cooled piston. This brought the average temperature to within the limit for steel-crown pistons. The average cylinder wall temperature for the split-cycle power cylinder was approximately 140 F (60 C) higher than the conventional engine. This could lead to problems with lube oil retention. The wall temperatures were calculated across the speed range and then averaged and applied as fixed wall temperatures for all remaining studies. Fixed surface temperatures for the expansion cylinder components were 860 F (733 K) for the piston, 629 F (605K) for the cylinder head, and 552 F (562K) for the liner. For the compression cylinder components, the surface temperatures were 399 F (473K) for the piston, 293 F (418K) for the cylinder head, and 314 F (430K) for the liner.

Table 7 summarizes the performance results for the initial split-cycle engine model. The results are listed in terms of indicated torque, indicated power, indicated mean effective pressure (IMEP), indicated thermal efficiency (ITE), and peak cylinder pressure.

TABLE 7

| Parameter | 1400 rpm | 1800 rpm | 2400 rpm | 3000 rpm |
|---|---|---|---|---|
| Summary of Predicted Engine Performance (English Units) | | | | |
| Indicated Torque (ft-lb) | 92.9 | 91.9 | 88.1 | 80.8 |
| Indicated Power (hp) | 24.8 | 31.5 | 40.3 | 46.2 |
| Net IMEP (psi) | 53.8 | 53.2 | 51.0 | 46.8 |
| ITE (%) | 36.1 | 35.8 | 34.6 | 33.0 |
| Peak Cylinder Pressure, Compression Cylinder (psi) | 630 | 656 | 730 | 807 |
| Peak Cylinder Pressure, Expansion Cylinder (psi) | 592 | 603 | 623 | 630 |
| Summary of Predicted Engine Performance (SI Units) | | | | |
| Indicated Torque (N-m) | 126.0 | 124.6 | 119.4 | 109.6 |
| Indicated Power (kW) | 18.5 | 23.5 | 30.0 | 34.4 |
| Net IMEP (bar) | 3.71 | 3.67 | 3.52 | 3.23 |
| ITE (%) | 36.1 | 35.8 | 34.6 | 33.0 |
| Peak Cylinder Pressure, Compression Cylinder (bar) | 43.4 | 45.2 | 50.3 | 55.6 |
| Peak Cylinder Pressure, Expansion Cylinder (bar) | 40.9 | 41.6 | 43.0 | 43.5 |

Figure 18:
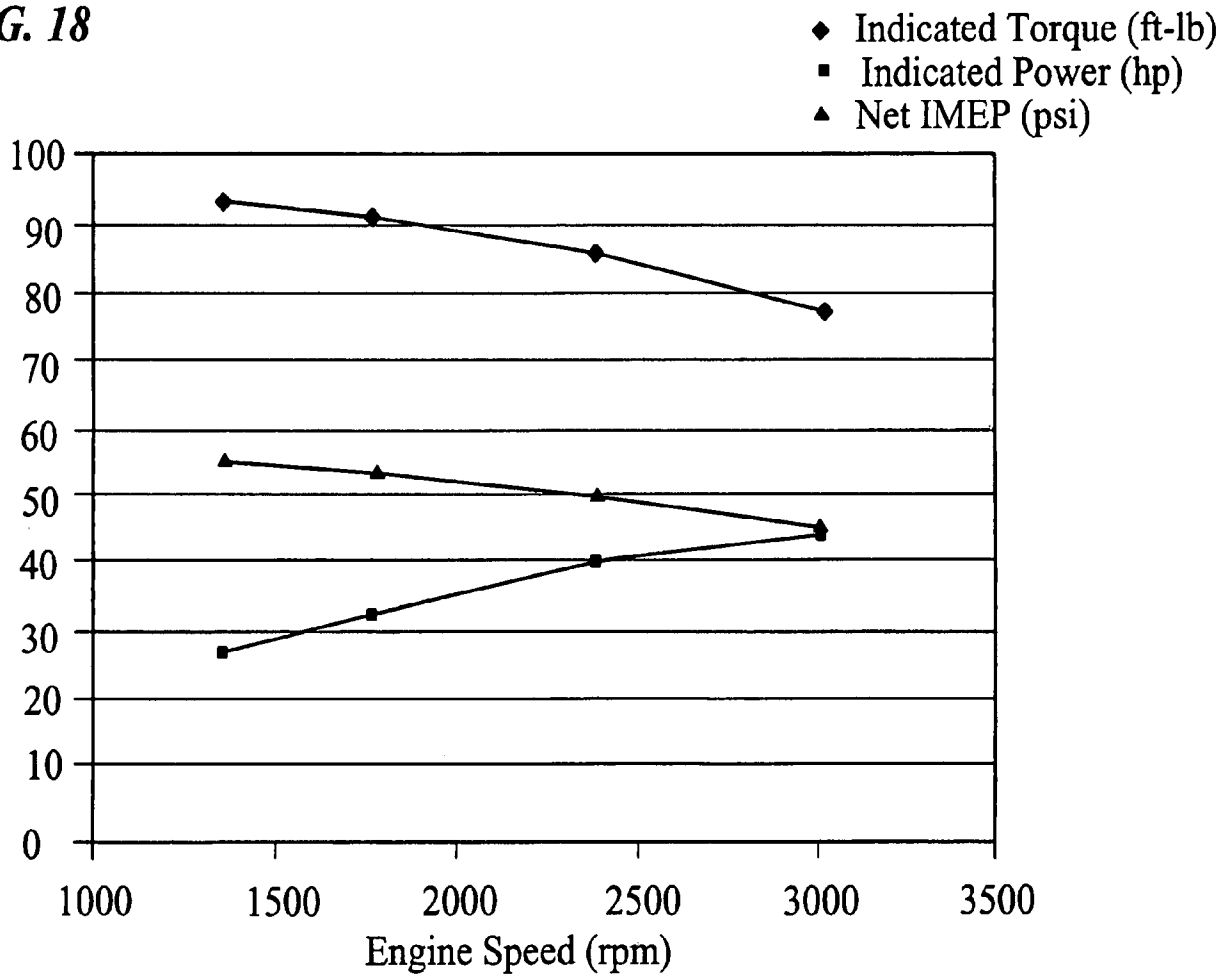
FIG. 18 is a graph of some of the initial performance parameters of the split-cycle engine of FIG. 15A.

FIG. 18 plots the performance in terms of indicated torque, indicated power, and new IMEP across the speed range. The trend of indicated torque and net IMEP is flat at 1400 and 1800 rpm, but drops off at the higher speeds. The power curve is somewhat linear. Most of the emphasis was focused on tuning for the 1400 rpm operating point, thus there was not much effort expended in optimizing high-speed engine operation.

3.2 Parametric Sweeps

Parametric sweeps were conducted to determine the influence of the following key variables on indicated thermal efficiency:

Crossover passage diameter,
Crossover valve diameter,
TDC phasing,
Crossover valve timing, duration, and lift,
10 to 90% burn duration,
Bore-to-Stroke ratio (constant displacement)
Expansion cylinder Expansion Ratio,
Heat transfer in crossover passage, and
In-cylinder heat transfer for expansion cylinder.

For all the parametric sweeps conducted, several runs were conducted at the 1400 rpm engine speed condition to determine the most promising configuration. Once that configuration was identified, runs were conducted across the speed range. The results are presented in terms of gains or losses in ITE relative to the results from the initial split-cycle engine model or previous best case.

3.2.1 Crossover Passage Diameter

The crossover passage diameter was varied from 0.59 in (15.0 mm) to 1.97 in (50.0 mm). At each step, the crossover valve diameter was changed such that the area of the two valves matched the area of the crossover passage outlet. The most promising configuration for the crossover passage was 1.18 in (30 mm) diameter inlet and outlet cross sections with two 0.83 in (21.2 mm) crossover valves. The inlet was modeled with a check valve with a realistic time constant. The gains in thermal efficiency across the speed range as a result of optimizing crossover passage diameter were minimal (less than 0.3 points ITE).

3.2.2 TDC Phasing

Sweeping the TDC phasing between the compression and power cylinders exerted a significant influence on thermal efficiency. The TDC phasing was swept between 18° and 30 CA. At each step, the 50% burn point and crossover valve timing were adjusted to maintain the phasing such that the 10% burn point occurred at or after the crossover valve closing (XVC) event. This was intended to prevent flame propagation into the crossover passage. The most promising configuration came from a TDC phasing of 20 CA. This demonstrated moderate gains across the speed range (1.3 to 1.9 points ITE relative to the previous 25 TDC phasing). Further studies to optimize the crossover valve duration and lift resulted in minimal improvement (less than 0.2 points ITE).

3.2.3 Combustion Duration

Changing the combustion duration, or 10 to 90% burn rates, also exerted a strong influence on the thermal efficiency. The initial setting for 10 to 90% combustion duration was set at 24 CA, which is a rapid burn duration for typical SI engines. The most important objective was to maintain the same type of combustion duration between the conventional and split-cycle engines. However, due to theories relating to faster burn rates that might be inherent in the split cycle engine, the engine's sensitivity with regards to a faster combustion event was examined. Reducing the 10 to 90% burn duration (increasing the burn rate) from 24 CA to 16 CA showed gains of up to 3 points ITE across the speed range.

This study was repeated for the conventional engine model to establish a reference point for comparison. The gains for the conventional engine were limited to 0.5 point ITE. For the conventional engine, combustion takes place at a near constant volume.

Figure 19:
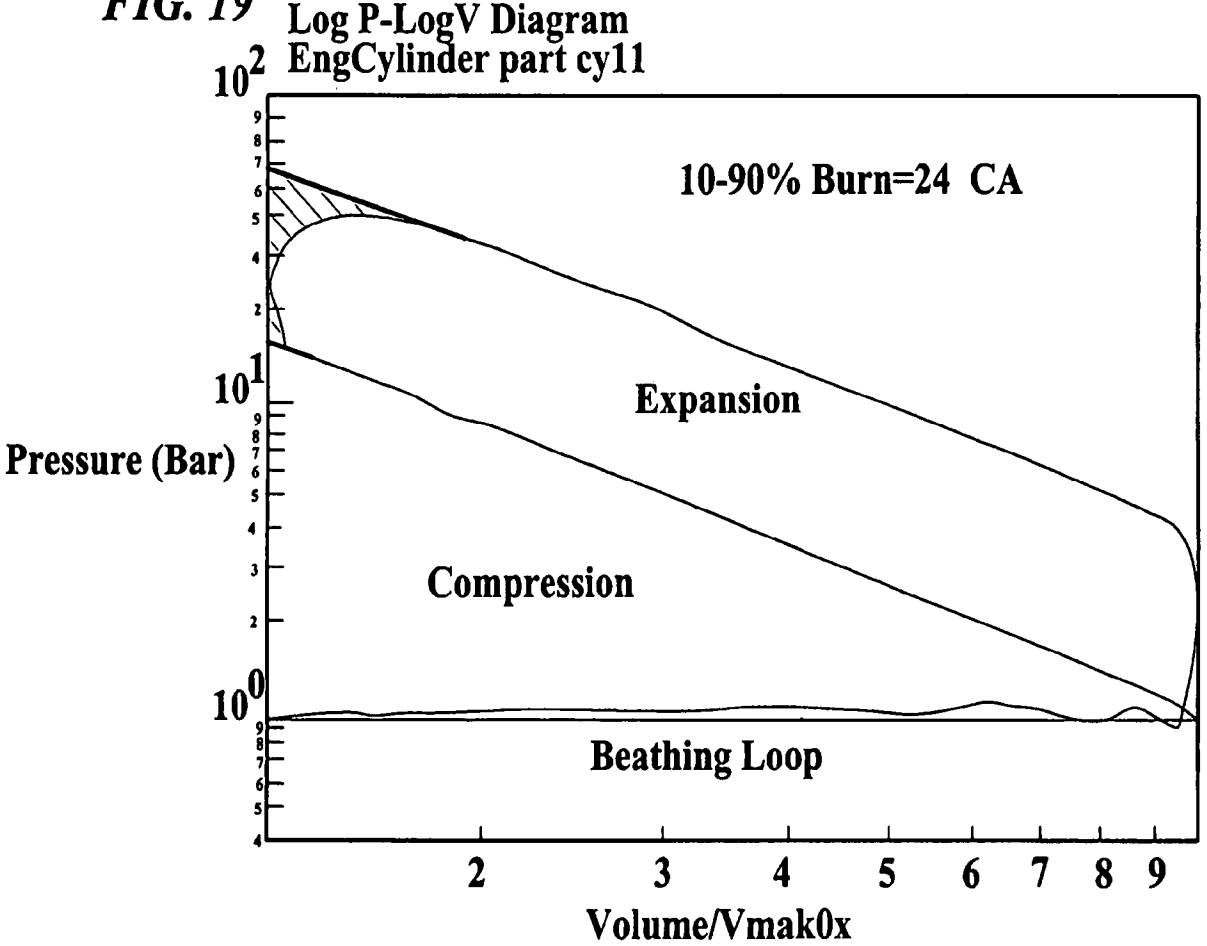
FIG. 19 is a log-log pressure volume diagram for a conventional engine.

Referring to FIG. 19, the log pressure vs. log volume (log-log P-V) diagram for the conventional engine at the 24 CA 10 to 90% burn duration is shown. When compared to the ideal Otto cycle constant volume heat addition line, there is a shaded region above where the combustion event transitions into the expansion stroke. By decreasing the burn duration to 16 CA, there is an increase in the amount of fuel burned near TDC that results in increased expansion work. In other words, the shaded region gets smaller, and the P-V curve more closely approximates the ideal Otto cycle. This leads to slight improvement in thermal efficiency. Engine manufacturers have invested significant development efforts in optimizing this trade-off for incremental improvements.

Figure 20:
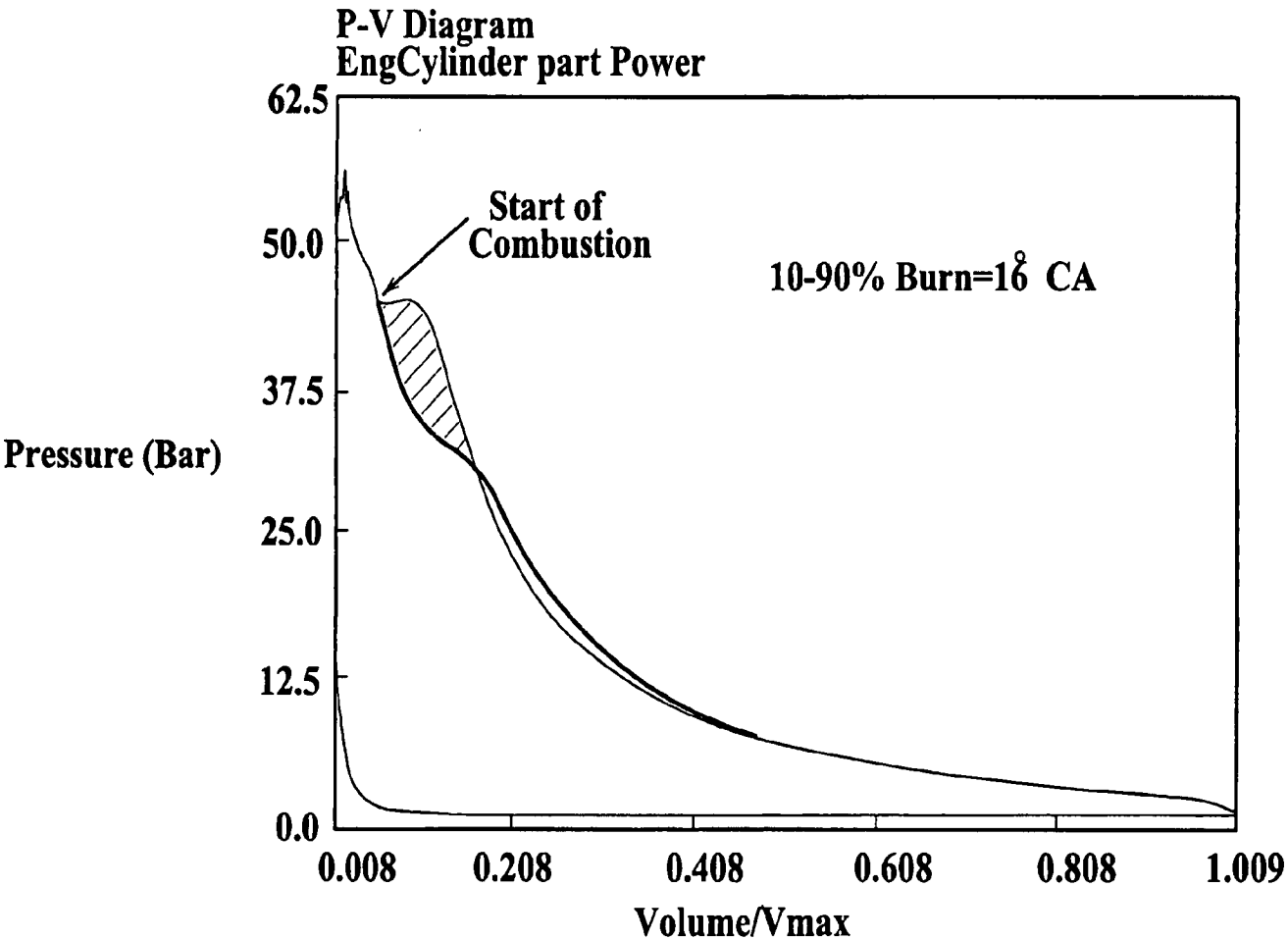
FIG. 20 is a pressure volume diagram for the power cylinder of a split-cycle engine in accordance with the present invention.

Referring to FIG. 20, the pressure volume diagram for the split-cycle engine is shown. The split-cycle engine expansion cylinder undergoes a much larger change in volume during the combustion event when compared to the conventional engine. This is illustrated in FIG. 20. The black line represents the 24 CA to 10 to 90% burn duration.

Thermal efficiency increases as combustion is shifted towards TDC for the split-cycle engine, but advance of the 10% burn point is limited by the timing of the crossover closing (XVC) event. Reducing the 10 to 90% burn duration effectively advances combustion, resulting in more pressure acting over a reduced change in volume. Thus, reducing the burn duration yields larger gains with the split-cycle engine than with the conventional engine.

A typical 10 to 90% burn duration or a conventional spark ignited gasoline engine is between 20 and 40 CA. One of the limiting factors in increasing burn rates is how much turbulence can be produced inside the cylinder, thus wrinkling the flame front and speeding up the flame propagation across the cylinder. The GT-Power Wiebe combustion model does not account for this level of complexity. It was hypothesized that, due to the intense motion and late timing of the crossover flow, the split-cycle engine expansion cylinder may experience a much larger degree of bulk air motion and turbulence at the time of combustion, thus leading to higher flame speeds than the conventional engine. It was decided to pursue computational fluid dynamics (CFD) analysis to more accurately model the combustion event and determine the types of burn rates possible for the split-cycle engine. This topic is covered in Section 3.3.

3.2.4 In-Cylinder Geometry

In the next set of parametric studies, the in-cylinder geometry was varied to determine the influence on thermal efficiency. The bore-to-stroke ratio was varied independently for the compression and power cylinders, holding displacement constant for each. For the compression cylinder, the bore-to-stroke ratio was swept from 0.80 to 1.20. The most promising compression cylinder bore-to-stroke ratio for the 1400 rpm engine speed was 0.90 (0.3 point ITE gain). However, this value did not result in gains for the other engine speeds. The decrease in bore-to-stroke ratio translates to a longer stroke and connecting rod, which increases engine weight, particularly for the engine block. There were no gains demonstrated from changing the bore-to-stroke ratio of the expansion cylinder. Increasing the Expansion Ratio of the expansion cylinder from 120 to 130 showed a gain of 0.7 point ITE for the 1400 rpm operating point. There was a slight penalty in ITE at the higher engine speeds, however. All signs indicate that if the engine were tuned for a 1400 rpm application, there would be some benefit in ITE from changing the compression cylinder bore-to-stroke ratio and the power cylinder Expansion Ratio. However, if tuning across the speed range, the values should be left unchanged.

3.2.5 Heat Transfer

Ceramic coatings were modeled and applied to the crossover passage to quantify potential gains in thermal efficiency due to retained heat and increased pressures in the passage. Using a thermal conductivity of 6.2 W/m–K, the emissivity and coating thickness were varied. The wall thickness, which was varied from 0.059 in (1.5 mm) to 0.276 in (7 mm), did not exert much influence on thermal efficiency. The 0.059 in (1.5 mm) thickness is a typical value used for ceramic coatings of engine components, so it was used as the default. Varying the emissivity, which can vary anywhere from 0.5 to 0.8 for a ceramic material, led to a shift of 0.2 points ITE, with the lower value of 0.5 yielding the best results. With this emissivity, there was a predicted gain of 0.7 points ITE across the speed range.

There was no quick straight forward method in GT-Power for applying ceramic coatings to the in-cylinder components. Rather than invest a great deal of time creating a sub-model to perform the necessary calculations, the material properties for the power cylinder piston and cylinder head were switched to ceramic. The results suggest that there could be gains as high as 2 points ITE across the speed range from using the ceramic components.

3.2.6 Summary of Results of ITE on the Split-Cycle Engine

Table 8 below tracks the changes in ITE through the course of the parametric studies.

TABLE 8

Indicated Thermal Efficiency Predictions for Split-Cycle Engine

| Configuration | 1400 rpm | 1800 rpm | 2400 rpm | 3000 rpm |
|---|---|---|---|---|
| Conventional engine model | 37.5 | 27.9 | 38.2 | 38.0 |
| Initial split-cycle engine model | 36.1 | 35.8 | 34.6 | 33.0 |
| 30-mm crossover passage | 36.2 | 36.0 | 34.9 | 33.3 |
| 20 TDC phasing | 37.5 | 37.5 | 36.6 | 35.2 |
| 16 10 to 90% burn duration | 40.6 | 40.6 | 40.0 | 38.6 |
| 1.5-mm ceramic coating (crossover) | 41.3 | 41.4 | 40.9 | 39.6 |
| Expansion cylinder ceramic components | 42.8 | 42.9 | 42.6 | 41.5 |

Figure 21:
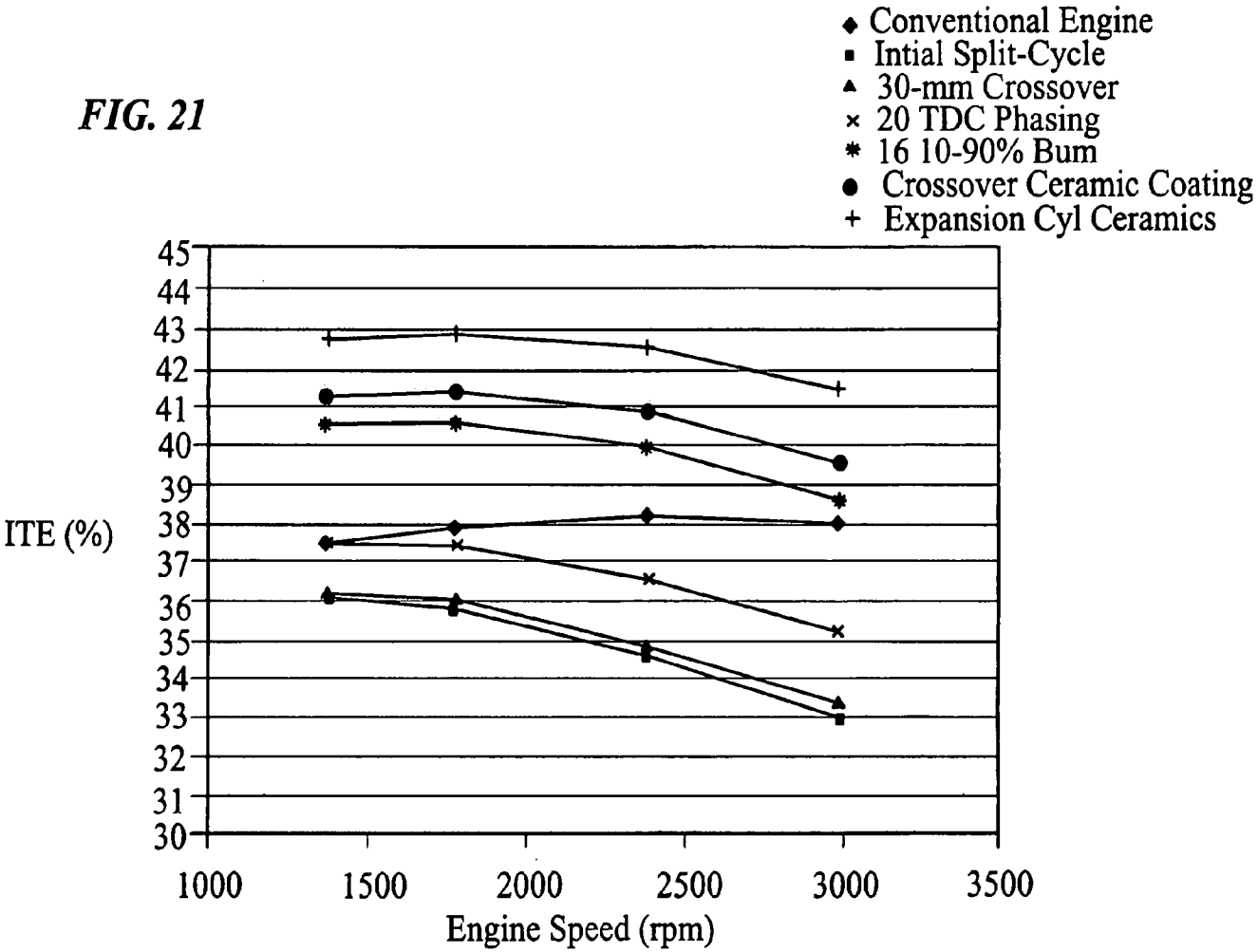
FIG. 21 is a comparison graph of indicated thermal efficiencies of a conventional engine and various split-cycle engines in accordance with the present invention.

Referring to FIG. 21, these results are displayed graphically. As a basis of comparison, the conventional engine yielded indicated thermal efficiencies in the range of 37.5% to 38.2% at similar power levels as the split-cycle engine. Speeding up the burn rates had the most significant influence of any of the variables investigated. The increased burn rates allowed the thermal efficiencies of the split-cycle engine to rise above the levels predicted for the conventional engine by approximately 3 points. Further potential increases were demonstrated with the use of ceramic coatings.

3.3 Combustion Analysis

The parametric sweep conducted in GT-Power demonstrated that the 10 to 90% burn duration had a significant influence on the ITE of the split-cycle engine. It was also hypothesized that the split-cycle engine expansion cylinder may experience higher levels of in cylinder bulk air motion and turbulence as compared to the conventional engine, thus yielding faster burn rates. The Wiebe combustion model used during the GT-Power cycle simulation studies produces heat release curves based on user inputs for the 50% burn point and 10 to 90% burn duration. It provides a rough approximation of the combustion event, but does not account for the effects of increased turbulence.

Computational fluid dynamics (CFD) was utilized to test the hypothesis and quantify the 10 to 90% burn duration achievable with the split-cycle engine concept. Computational Fluid Dynamics refers to a field of software that reduces a complex geometric field into tiny pieces (referred to as a "elements" which are separated by the "grid"). The applicable governing equations (fluid flow, conservation of mass, momentum, energy) are then solved in each of these elements. Stepping forward in time and completing these calculations for each element for each time step allows the solving of very complex flow fields but requires high computational power.

CFD models were constructed of both the conventional and split-cycle engines to provide comparative analyses. The intake valve events and spark timing were adjusted for the conventional engine to match the trapped mass and 50% burn point from the cycle simulation results. The resulting 10 to 90% burn duration from CFD was approximately 24 CA, which matched the value used in the GT-Power Wiebe combustion model.

For the split-cycle model, the inputs included fixed wall temperatures assuming ceramic coating on the crossover passage, but no ceramic components in the expansion cylinder. The early portion of the burn occurs with the crossover valve open. The interaction between the intake charge from the crossover passage and the expansion cylinder pressure rise from combustion effects the trapped mass. Several iterations were required to match the trapped mass from the conventional engine within 4%. The first set of results had a significant amount of overlap with approximately 35% of the total combustion event (i.e. from the 0% point to the 100% point of combustion) occurring prior to crossover valve closing. (This will be referred to as 35% "burn overlap" from hereon.) The CFD model had combustion disabled in the crossover passage. However, by reviewing the results, it became clear that this amount of overlap would have more than likely resulted in flame propagation into the crossover passage. The resulting 10 to 90% burn duration was approximately 10 CA.

Figure 22:
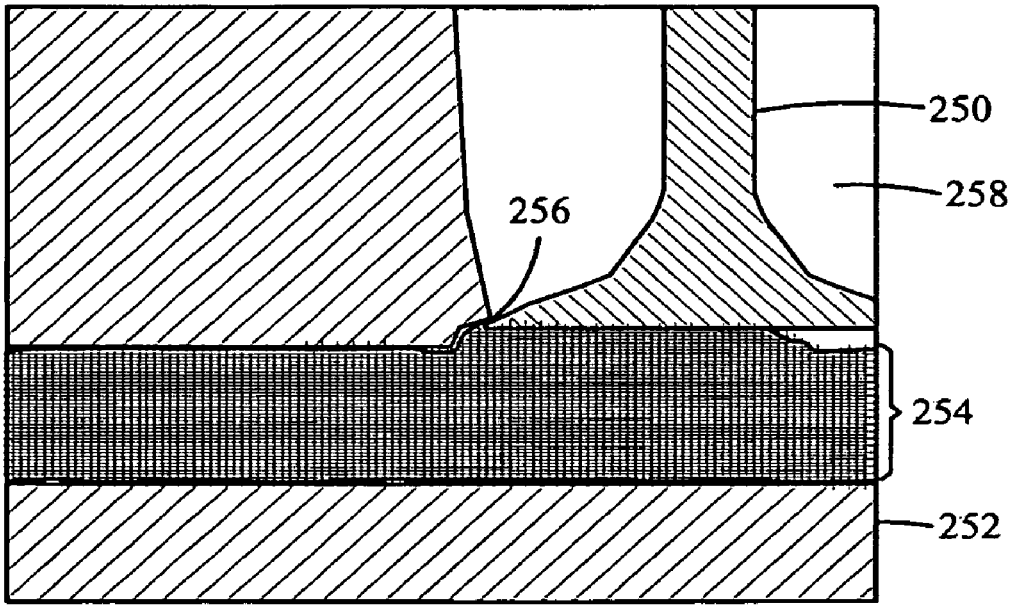
FIG. 22 is a CFD predicted diagram of the flame front position between the crossover valve and expansion piston for a 35% burn overlap case.

Referring to FIG. 22, the case with the 35% burn overlap is illustrated as calculated via the CFD analysis. The crossover valve 250 is closed after approximately 35% of the burn occurs and the expansion piston 252 is being driven downward by the hot gases. The flame front 254 (the dark shaded area) has progressed passed the crossover valve seat 256. Accordingly, it is likely that in this embodiment the flame front 254 would be able to creep into the crossover passage 258.

Another iteration was conducted to reduce the burn overlap. The target was less than 10% of the burn occurring prior to crossover valve closing. Again, several iterations were required to match the trapped mass. This case resulted in approximately 5% of the total combustion event (i.e. from the 0% point to the 100% point of combustion) occurring prior to crossover valve closing. The 10 to 90% burn duration was approximately 22 CA. The amount of overlap between the crossover valve and combustion events exerted a significant influence on the burn duration.

Figure 23:
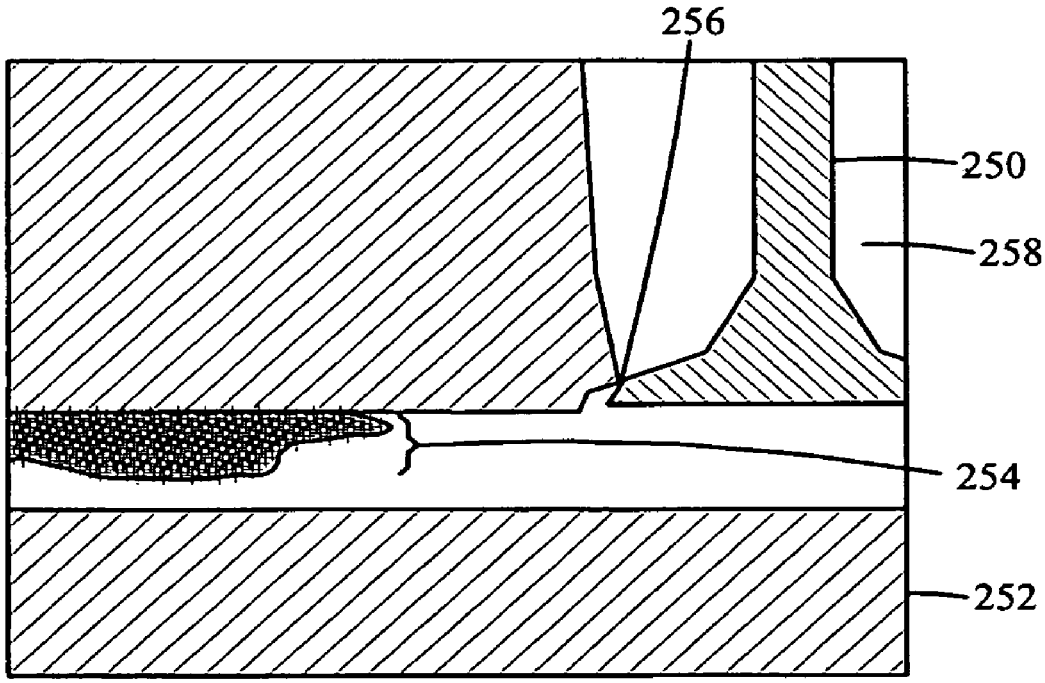
FIG. 23 is a CFD predicted diagram of the flame front position between the crossover valve and expansion piston for a 5% burn overlap case.

Referring to FIG. 23, the case of the 5% burn overlap is illustrated as calculated via the CFD analysis. The crossover valve 250 is closed after approximately 5% of the burn occurs and the expansion piston 252 is being driven downward by the hot gases. The flame front 254 (the dark shaded area) has not progressed past the crossover valve seat 256. Accordingly, it is likely that in this embodiment the flame front 254 would not be able to creep into the crossover passage 258.

One interesting discovery from the CFD analysis was that the split-cycle engine appears to have a potential inherent advantage over the conventional engine in terms of $NO_x$ emissions. The predicted $NO_x$ emissions for the 10 CA 10 to 90% burn duration split-cycle engine case were roughly 50% of the $NO_x$ emissions predicted for the conventional engine, while the 22 CA 10 to 90% burn duration case resulted in approximately 20% of the conventional engine $NO_x$ emissions. The high rate of expansion during combustion found in the split-cycle engine will result in a reduction of the maximum end-gas temperatures that are normally experienced in a conventional engine, which burns at almost constant volume. Therefore the trend of these results appears to be reasonable.

Typical SI gasoline automotive engines operate at stoichiometric or slightly rich air/fuel ratios at full load. Thermal efficiency tends to improve with lean air/fuel ratios, but with increased $NO_x$ emissions and severely degraded catalyst performance. The inability of the catalyst to effectively reduce $NO_x$ emissions under these conditions further aggravates the tailpipe $NO_x$ levels. The predicted $NO_x$ emissions for the conventional engine operating at 18:1 air/fuel ratio are likely higher than what would be representative of typical engines operating at stoichiometric or slightly rich air/fuel ratios.

These results have not been correlated to experimental data and emissions predictions from numerical models tend to be highly dependent on tracking of trace species through the combustion event. If these results were confirmed on an actual test engine, they would constitute a significant advantage of the split-cycle engine concept. Predicted CO emissions were higher for the split-cycle engine, but these species are easier to oxidize under lean operating conditions than $NO_x$ using readily-available exhaust after treatment devices such as oxidation catalysts.

Figure 24:
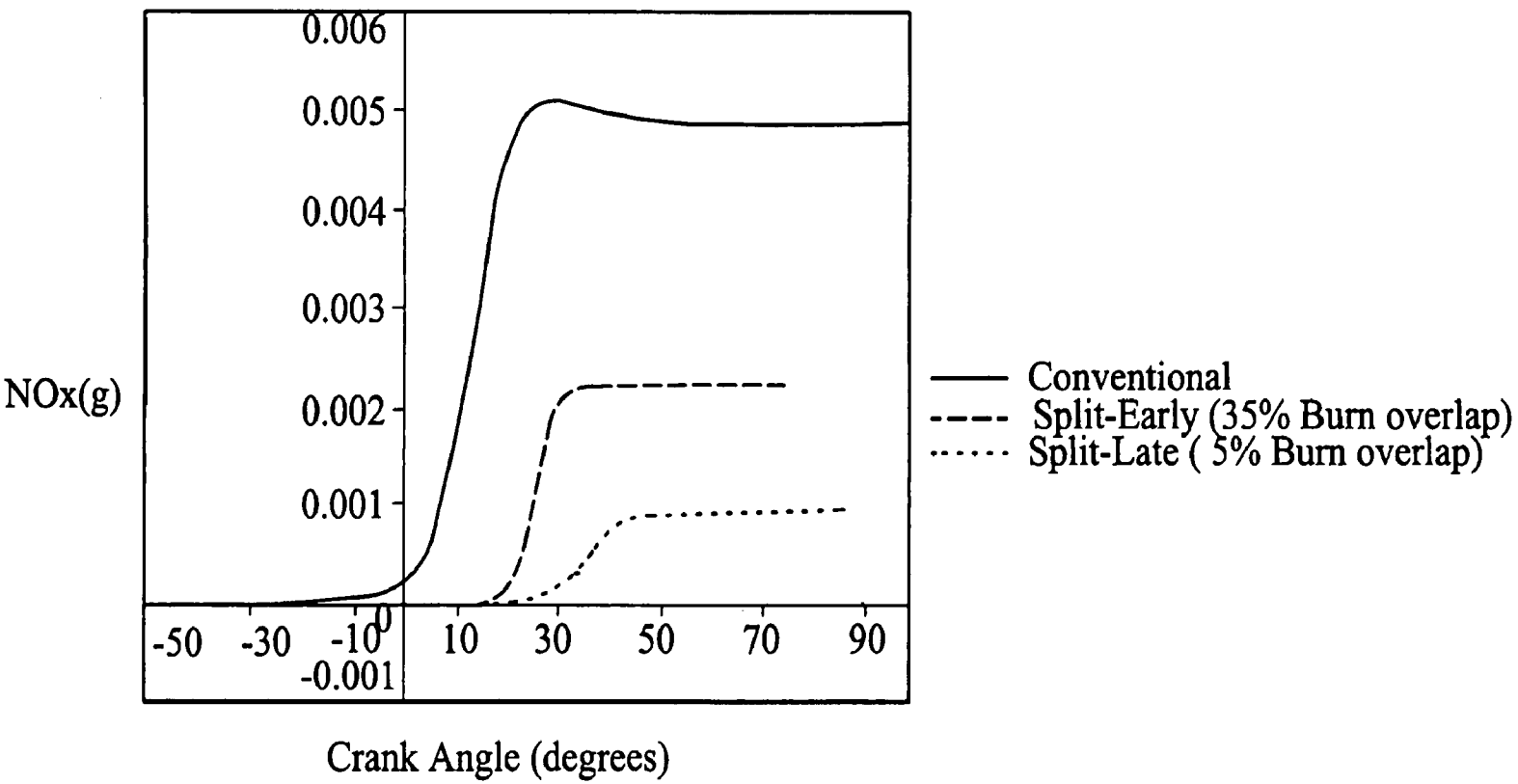
FIG. 24 is a CFD predicted graph of $NO_x$ emissions for a conventional engine, a split-cycle engine 5% burn overlap case and a split-cycle engine 35% burn overlap case.

Referring to FIG. 24, the predicted $NO_x$ emissions for all three cases, i.e. conventional engine, split-early (5% burn overlap) and split-late (35% burn overlap), are shown. Experience indicates that the relative $NO_x$ trend between cases is accurately predicted, but that the absolute magnitude may not be. Both of the split-cycle cases have combustion events later in the cycle than the conventional case, resulting in less overall time at high temperatures, and thus less $NO_x$ than the conventional case. The later timing case produced very little $NO_x$ because the late combustion resulted in lower cylinder temperatures. The expansion cycle was well underway when combustion was occurring.

The lower cylinder temperatures for the late burn split-cycle case resulted in increased CO emissions when compared to both the conventional engine and the early timing split cycle engine case. The final CO concentrations were 39, 29, and 109 ppm for the conventional, early timing split-cycle, and late timing split cycle respectively.

3.4 Friction Study

The friction model used in GT-Power is based on the Chen-Flynn correlation, which predicts friction using the following empirical relationship:

$$FMEP = a \times PCP + b - V_p + c \times V_p^2 + d, \text{ where}$$

FMEP: friction mean effective pressure (or friction torque per displacement).

a, b, c, d: correlation coefficients (tuning parameters)

PCP: peak cylinder pressure, and $V_p$: mean piston speed.

This correlation has been well developed over some time for conventional piston engines and reasonable values for the correlation coefficients have been validated against experimental data. However, the empirical mode does not take into account the unique piston motion and connecting rod angle of the split-cycle engine concept.

The dominant source of engine rubbing friction comes from the piston assembly. More specifically, the dominant source of piston assembly friction comes from contact between the piston rings and cylinder liner. To determine the inherent differences in engine friction between the conventional and split-cycle engines, friction calculations were performed outside of GT-Power. Piston thrust loading was calculated as a function of the cylinder pressure vs. crank angle data imported from GT-Power in a spreadsheet format. Friction force was determined by multiplying this force by an average (constant) coefficient of friction value. The friction work was calculated by integrating the F-dx work throughout the stroke in increments of 0.2 CA. It was assumed that the sum of F-dx friction work accounted for half of the total engine friction. The average coefficient of friction value was determined by matching the predicted friction work from the spread sheet to friction work predicted from the Chen-Flynn correlation for the conventional engine at 1400 rpm. This value was then applied to the split-cycle engine to predict the piston assembly friction. The remaining half of friction was assumed to remain constant between the two engine configurations, as it deals with valve train, bearing friction, and accessory losses. FMEP varies with engine speed, and the 1400 rpm point was selected to remain consistent with the previous parametric studies.

The amount of friction work accounts for the differences between indicated and brake work for a given engine. The friction torque and power values were very similar between the conventional and the split-cycle engines with 22° 10 to 90% burn duration. However, the results suggest that the split-cycle engine may have a slightly higher mechanical efficiency than the conventional engine as the 10 to 90% burn duration is shortened from 22 CA. For example, at the 16 CA 10 to 90% burn duration, the split-cycle engine had a 1.0 point advantage in mechanical efficiency, which translates to a 1.0 point gain in BTE.

Figure 25:
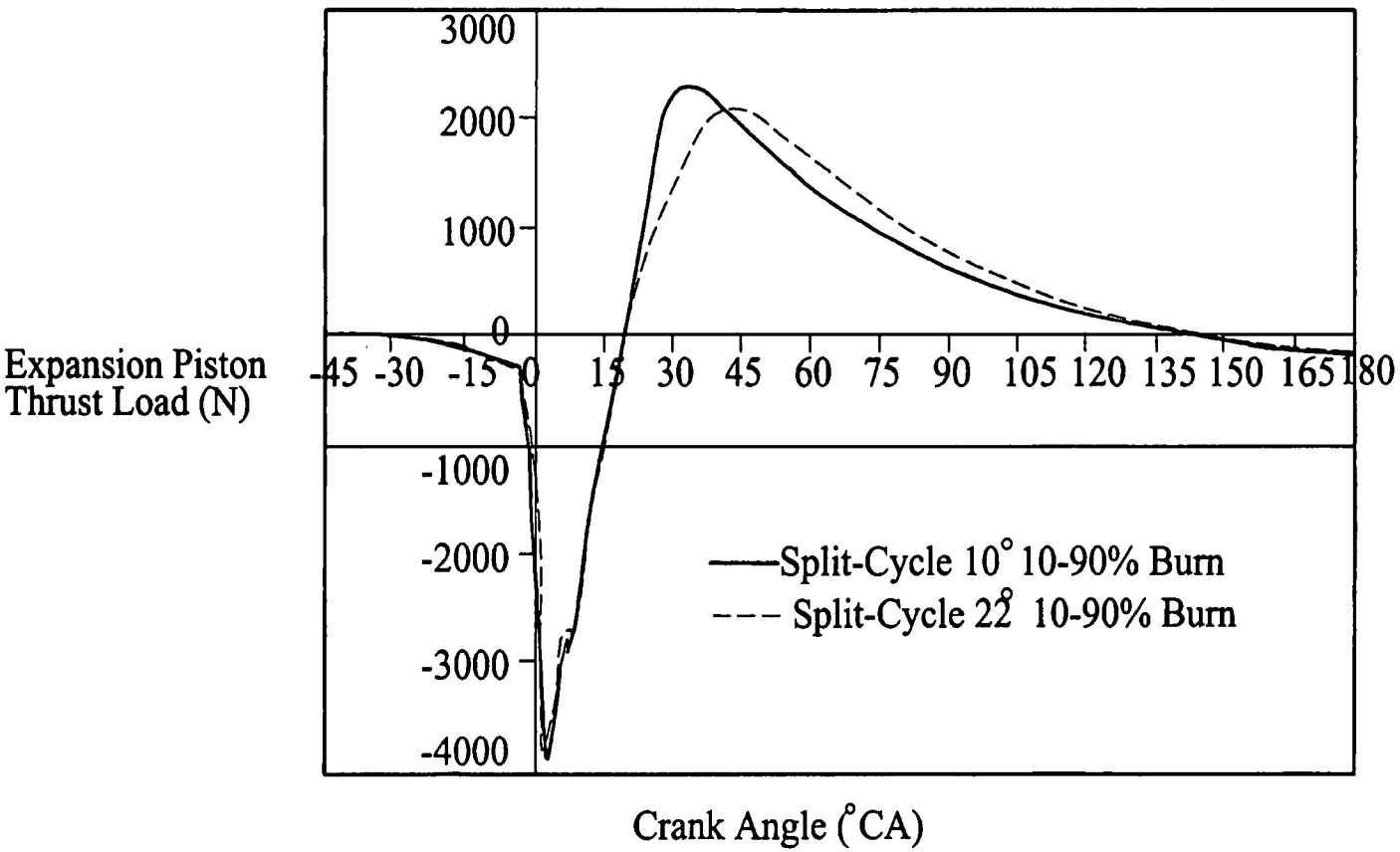
FIG. 25 is a graph of the expansion piston thrust load for the split-cycle engine.

Referring to FIG. 25, the reasons for this trend is illustrated. FIG. 25 plots the expansion piston thrust load versus crank angle, referenced to TDC of the expansion piston, for the 10 CA and 22 CA 10 to 90% burn duration cases. The 10 CA 10 to 90% burn duration resulted in a mechanical efficiency approximately 1.2 points higher than the 22 CA case. For the 10 CA 10 to 90% burn duration case, thrust loading increased more rapidly after the connecting rod passed through the 0 angle point. Even though the 10 CA case reached a higher peak thrust load, the 22 CA case maintained a slightly higher thrust load than the 10 CA case through the remainder of the stroke. When the integration of F-dx is performed, the 10 CA had lower piston friction work.

3.5 Summary of the Results for the Split-Cycle Engine

The resulting burn rates from the CFD combustion analysis were used to set up and run additional iterations in GT-Power for the split-cycle engine. Table 9 summarizes the results and compares them to the conventional engine in terms of indicated, friction, and brake values. All runs were conducted at an engine speed of 1400 rpm.

TABLE 9

| Parameter | Conventional (Run #96) | Split-Cycle (Run #180) | Split-Cycle (Run #181) | Split-Cycle (Run #183) |
|---|---|---|---|---|
| Summary of Results (English Units) | | | | |
| 10-90% Burn Duration (CA) | 24 | 16 | 10 | 22 |
| 50% Burn Point (ATDC) | 10 | 28 | 24 | 32 |
| Indicated Torque (ft-lb) | 91.8 | 102.4 | 103.6 | 93.7 |
| Indicated Power (hp) | 24.2 | 27.0 | 27.2 | 24.6 |
| ITE (%) | 37.5 | 41.2 | 42.7 | 38.2 |
| Friction Torque (ft-lb) | 10.4 | 10.5 | 10.3 | 10.4 |
| Friction Power (hp) | 2.76 | 2.79 | 2.74 | 2.78 |
| Brake Torque (ft-lb) | 81.4 | 92.0 | 93.3 | 83.3 |
| Brake Power (hp) | 21.4 | 24.5 | 24.9 | 22.3 |
| Mechanical Efficiency (%) | 88.7 | 89.8 | 90.1 | 88.9 |
| BTE (%) | 33.2 | 37.0 | 38.4 | 33.9 |
| Summary of Results (SI Units) | | | | |
| 10-90% Burn Duration (CA) | 24 | 16 | 10 | 22 |
| 50% Burn Point (ATDC) | 10 | 28 | 24 | 32 |
| Indicated Torque (N-m) | 124.4 | 138.9 | 140.5 | 127.0 |
| Indicated Power (kW) | 18.0 | 20.2 | 20.3 | 18.4 |
| ITE (%) | 37.5 | 41.2 | 42.7 | 38.2 |
| Friction Torque (N-m) | 14.1 | 14.2 | 13.9 | 14.1 |
| Friction Power (kW) | 2.07 | 2.08 | 2.04 | 2.07 |
| Brake Torque (N-m) | 110.3 | 124.7 | 126.5 | 112.9 |
| Brake Power (kW) | 16.0 | 18.3 | 18.6 | 16.6 |
| Mechanical Efficiency (%) | 88.7 | 89.8 | 90.1 | 88.9 |
| BTE (%) | 33.2 | 37.0 | 38.4 | 33.9 |

Split-cycle run #180 represents the 16 CA 10 to 90% burn duration from the previous parametric sweeps. Run #181 represents the first iteration of CFD combustion analysis conducted on the split-cycle engine model. This run resulted in approximately 35% of the burn occurring prior to crossover valve closing, which would likely lead to flame propagation into the crossover passage. Run #183 represents the second iteration of CFD combustion analysis, with approximately 5% of the burn occurring at crossover valve closing.

The 10 CA 10 to 90% burn duration from run #181 yielded a gain of approximately 5.0 points BTE over the conventional engine. However, in the current configuration, these conditions would likely lead to flame propagation into the crossover passage. The 22 CA 10 to 90% burn duration from run #183 is realistically achievable with respect to avoidance of flame propagation into the crossover passage, and resulted in a gain of approximately 0.7 points ITE.

3.6 Investigation of Lower Limits for Significant Parameters

The studies conducted during construction of the initial split-cycle model and subsequent parametric sweeps identified Compression Ratio, Expansion Ratio, TDC phasing, and burn duration as significant variables affecting engine performance and efficiency. Additional cycle simulation runs were performed to identify lower limits of Compression Ratio, Expansion Ratio, TDC phasing, and crossover valve lift and duration where engine performance and/or efficiency tails off.

The baseline for comparison was the split-cycle engine with a 10 to 90% burn duration of 22° CA (Run #183). Sweeps were conducted from this base configuration to quantify indicated power and ITE as functions of Compression Ratio, Expansion Ratio, TDC phasing, and crossover valve lift and duration. It should be noted that the inter-dependent effects of these variables exert a significant influence on the performance and efficiency of the split-cycle engine concept. For this study, the effects of each of these variables were isolated. No sweeps were conducted to analyze the combined influence of the variables. Altering each of these variables exerts a strong influence on trapped mass, so relative comparisons to run #183 or the conventional engine may not be valid.

Figure 26:
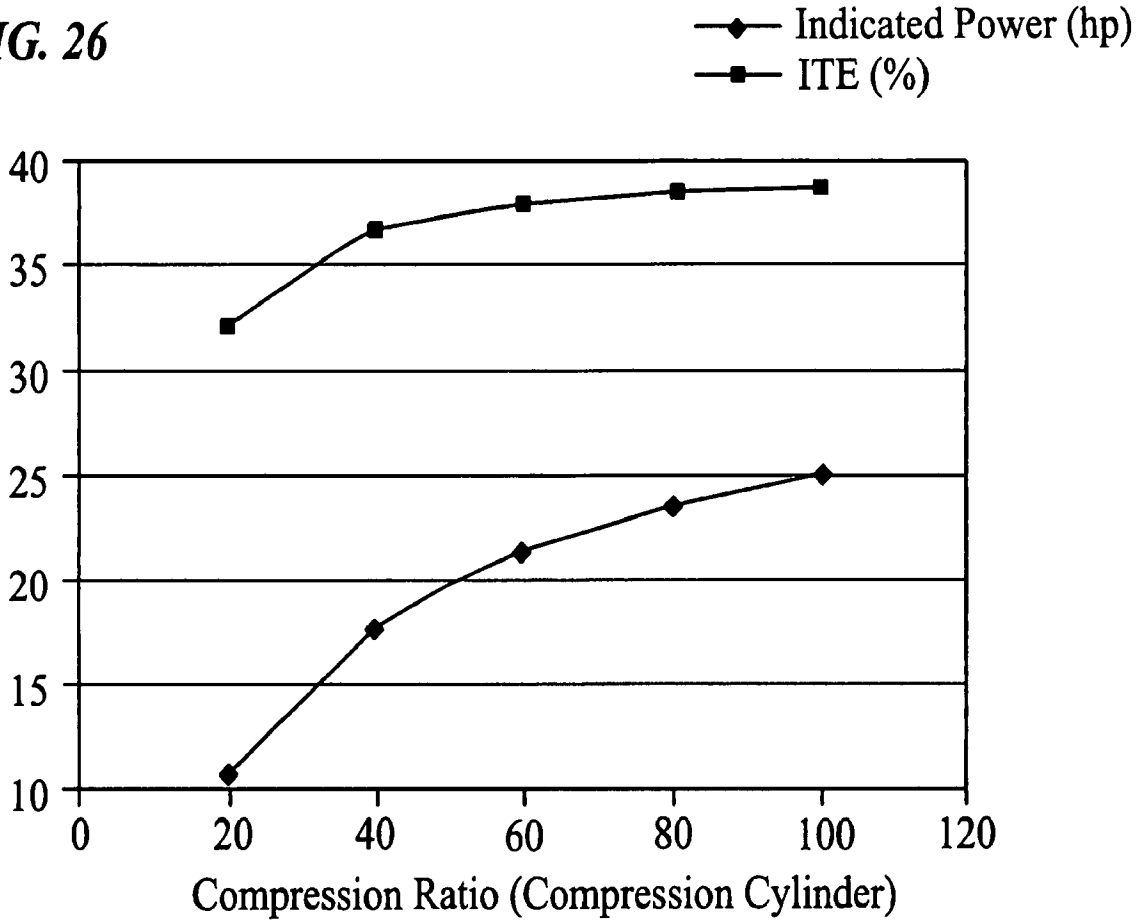
FIG. 26 is a graph of indicated power and thermal efficiency vs. Compression Ratio for a split-cycle engine in accordance with the present invention.

FIG. 26 shows the indicated power and ITE for various Compression Ratios. The baseline was set at a Compression Ratio of 100:1. Reducing this value to 80:1 results in a 6% decrease in airflow and indicated power. ITE decreases with Compression Ratio also, but more dramatically at 40:1 and lower.

Figure 27:
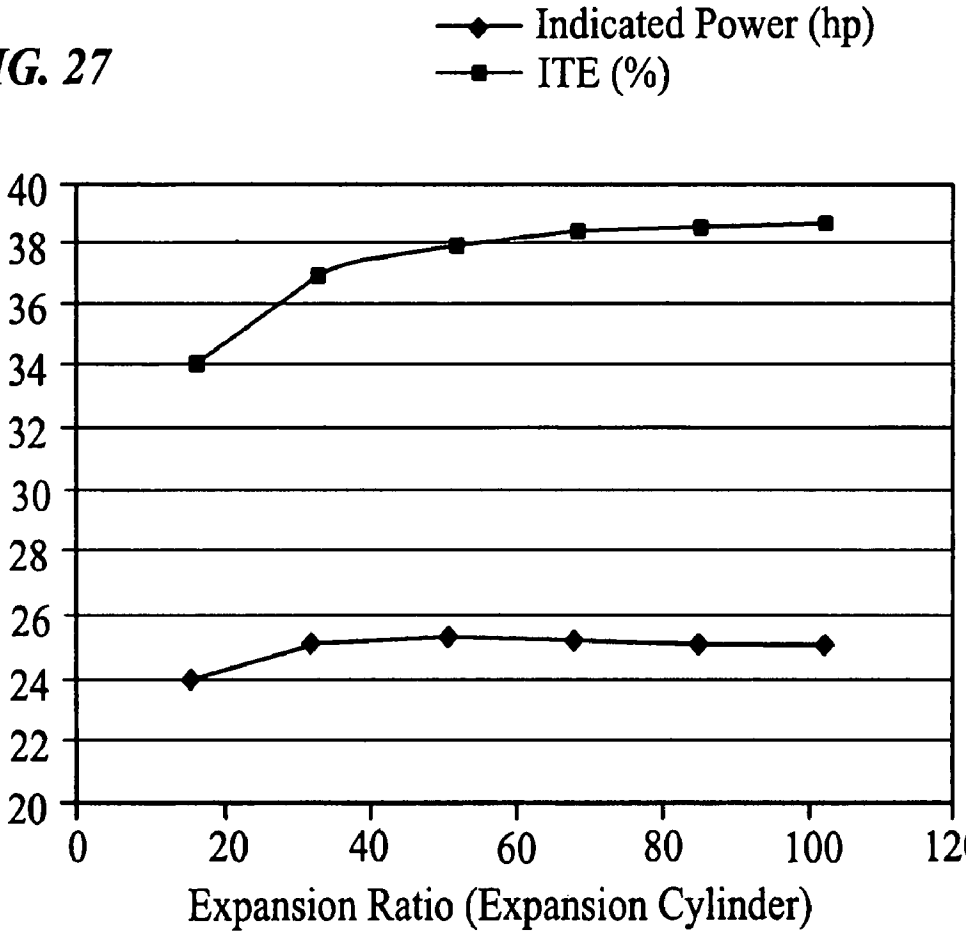
FIG. 27 is a graph of indicated power and thermal efficiency vs. Expansion Ratio for a split cycle engine in accordance with the present invention.

FIG. 27 plots indicated power and ITE for various Expansion Ratios. Indicated power was somewhat steady with slight increases in airflow as Expansion Ratio was decreased from the initial value of 120:1. At 40:1, airflow into the cylinder was 5% high with a moderate drop in ITE. At 20:1, airflow was 9% high, indicated power was 4% low, and ITE was more than 4.0 points lower than the baseline.

Figure 28:
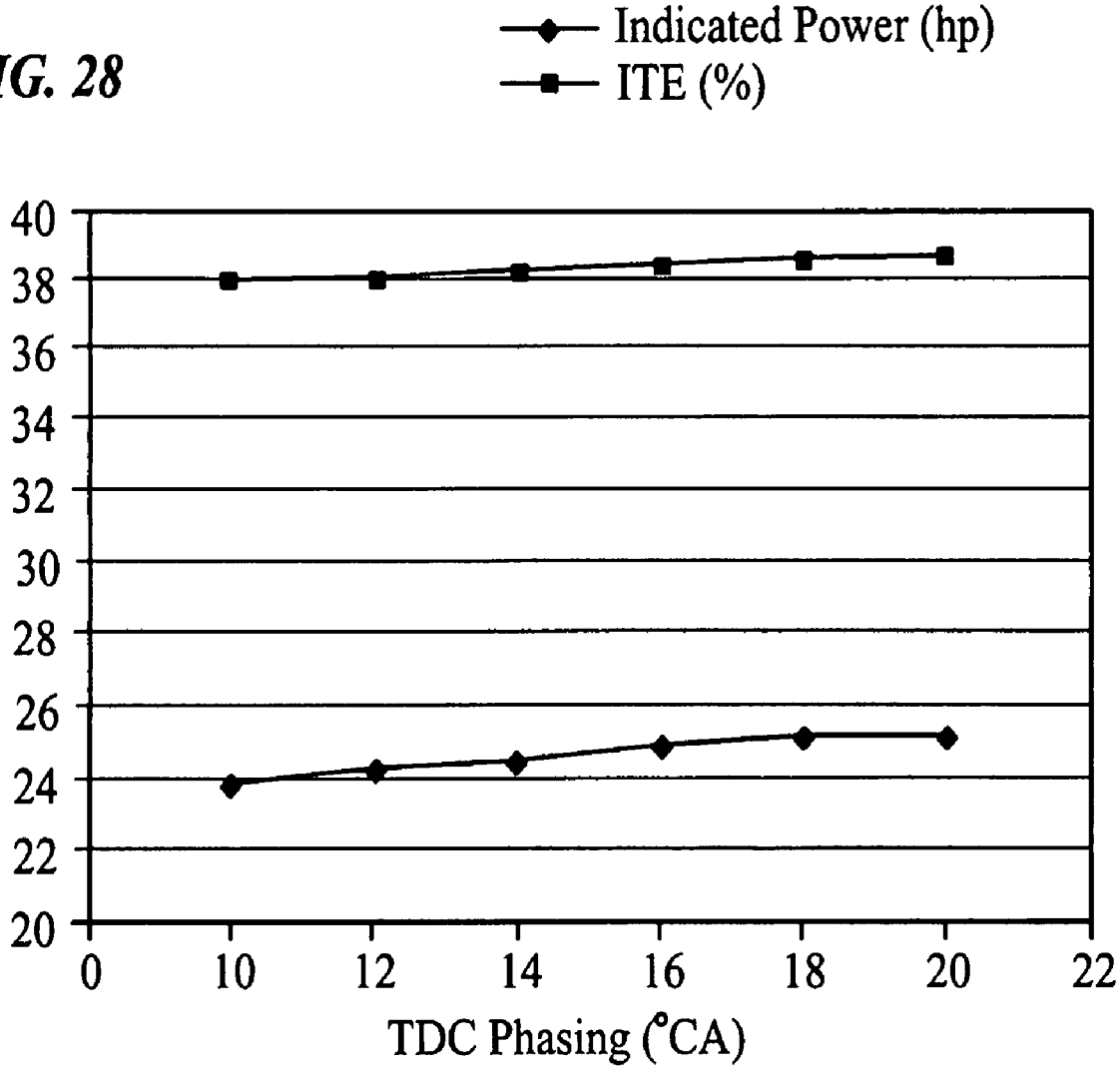
FIG. 28 is a graph of indicated power and thermal efficiency vs. TDC phasing for a split cycle engine in accordance with the present invention.

FIG. 28 plots the same data for various TDC phase angles. During these runs, the phasing for the crossover valve and combustion events were left unchanged in relation to the expansion piston's TDC. There was a moderate drop in ITE as the TDC phasing was reduced from the original value of 20° CA. Airflow and indicated power decrease more sharply with TDC phase angle. Also, friction is increased due to higher peak cylinder pressures. At a TDC phasing of 10°, airflow and indicated power were approximately 4% down from the baseline, with a 0.7 point drop in ITE, as well as an additional 0.5 point penalty in BTE due to increased friction.

The leveling out of performance at higher phasing offset angles may not be representative of realistic engine operation. At this point, with the approach taken here in the investigation of lower limits section of the study, the crossover valve event and compression event are grossly mis-timed such that the split-cycle concept is not accurately represented. At the late phasing, the crossover valve opens before the compressor cylinder begins charging the crossover in earnest, such that the basic process is to accumulate mass in the crossover passage on one cycle and then allow it to enter the power cylinder on the next cycle. That is the reason for the flatness of the curve at those high phasing angles.

Figure 29:
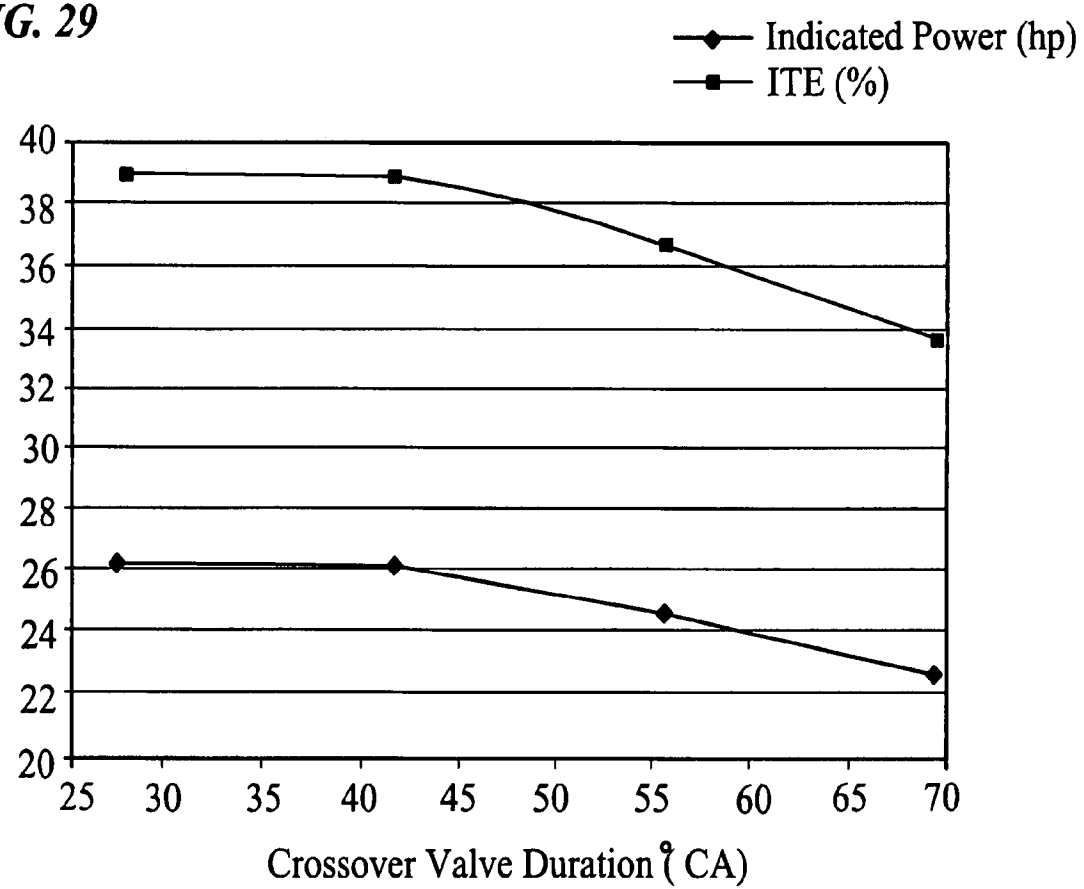
FIG. 29 is a graph of indicated power and thermal efficiency vs. crossover valve duration for a split cycle engine in accordance with the present invention.

FIG. 29 plots the same results as a function of crossover valve duration and lift. Comparing tables 2 and 6, it can be seen that the crossover valve duration of the split-cycle engine (i.e., 30 CA) is much smaller than the intake and exhaust valve durations of the conventional engine (225 CA and 270 CA respectively). The crossover valve duration is typically 70 CA or less, and preferably 40 CA or less, in order to be able to remain open long enough to transfer the entire mass of a charge of fuel into the expansion cylinder, yet close soon enough to prevent combustion from occurring within the crossover passage. It was found that the crossover valve duration had a significant effect on both burn rate and ITE.

A multiplying factor was applied to increase duration and lift simultaneously. The valve opening point was held constant, thus the valve closing event varied with duration. Since the combustion event was held constant, an increased crossover valve duration results in a higher fraction of combustion occurring with the crossover valve open, which can lead to flame propagation into the crossover passage for the current split-cycle engine configuration. Retarding the combustion along with stretching the valve event would result in a sharper thermal efficiency penalty than shown here.

Stretching the valve duration and lift results in increased airflow. Applying multiplying factors that result in crossover valve duration up to 42° CA, results in slight increases in indicated power from the increased airflow. Note that the multiplier for 42° CA also gives a maximum lift of 3.3 mm. The relationship between duration and maximum lift for FIG.

15 is shown in table 10. For reference, the baseline configuration (Run #183) had a crossover valve duration of 25° CA and a maximum lift of 2.27 mm. Thermal efficiency and indicated power drop off significantly, however, with further stretching of the valve events. Using a duration of 69° CA (and attendant increase in lift) results in 10% higher airflow, a 9.5% drop in indicated power, and a 5.0 point drop in ITE. Table 10 below shows the relationship between crossover valve duration and lift for the FIG. 29 study.

TABLE 10

Relationship Between Crossover Valve Duration and Lift for FIG. 29 Study

| CV dur ° CA | CV max lift mm | |
|---|---|---|
| 25 | 2.27 | Run #183 |
| 27.8 | 2.2 | |
| 41.7 | 3.3 | |
| 55.6 | 4.4 | |
| 69.4 | 5.5 | |

4.0 Conclusion

The Computerized Study identified Compression Ratio, Expansion Ratio, TDC phasing (i.e., the phase angle between the compression and expansion pistons (see item 172 of FIG. 6)), crossover valve duration and combustion duration as significant variables affecting engine performance and efficiency of the split-cycle engine. Specifically the parameters were set as follows:

the compression and Expansion Ratios should be equal to or greater than 20 to 1 and were set at 100 to 1 and 120 to 1 respectively for this Study;

the phase angle should be less than or equal to 50 degrees and was set at approximately 20 degrees for this study; and the crossover valve duration should be less than or equal to 69 degrees and was set at approximately 25 degrees for this Study.

Moreover, the crossover valve duration and the combustion duration should overlap by a predetermined percent of the combustion event for enhanced efficiency levels. For this Study, CFD calculations showed that an overlap of 5% of the total combustion event was realistic and that greater overlaps are achievable with 35% forming the unachievable upper limit for the embodiments modeled in this study.

When the parameters are applied in the proper configuration, the split-cycle engine displayed significant advantages in both brake thermal efficiency (BTE) and $NO_x$ emissions.

While various embodiments are shown and described herein, various modifications and substitutions may be made thereto without departing from the spirit and scope of the invention. Accordingly, it is to be understood that the present invention has been described by way of illustration and not limitation.

The invention claimed is:

1. An engine comprising:

a crankshaft, rotating about a crankshaft axis of the engine;

an expansion piston slidably received within an expansion cylinder and operatively connected to the crankshaft such that the expansion piston reciprocates through an expansion stroke and an exhaust stroke of a four stroke cycle during a single rotation of the crankshaft;

a compression piston slidably received within a compression cylinder and operatively connected to the crankshaft such that the compression piston reciprocates through an intake stroke and a compression stroke of the same four stroke cycle during the same rotation of the crankshaft; and a crossover passage interconnecting the compression and expansion cylinders, the crossover passage including an inlet valve and a crossover valve defining a pressure chamber therebetween; characterized in that the ratio of cylinder volumes from bottom dead center (BDC) to top dead center (TDC) for either one of the expansion cylinder and compression cylinder being 40 to 1 or greater; and the engine comprises a fuel injection system operable to add fuel to the exit end of the crossover passage.

2. The engine of claim 1 wherein the ratio of cylinder volumes from BDC to TDC for either one of the expansion cylinder and compression cylinder is 80 to 1 or greater.

3. The engine of claim 1 wherein the expansion piston leads the compression piston by a phase angle of substantially 50° crank angle or less.

4. The engine of claim 3 wherein said phase angle is less than 30° crank angle.

5. The engine of claim 3 wherein said phase angle is substantially 25° crank angle or less.

6. The engine of claim 1, wherein the crossover valve has a crossover valve duration between the crossover valve opening and closing of substantially 70° of crank angle or less.

7. The engine of claim 6 wherein said crossover valve duration is 69° of crank angle or less.

8. The engine of claim 6 wherein said crossover valve duration is substantially 50° of crank angle or less.

9. The engine of claim 6 wherein said crossover valve duration is 40° or less.

10. The engine of claim 6 wherein said crossover valve duration is substantially 35° of crank angle or less.

11. The engine of claim 6 wherein said crossover valve duration is approximately 25°.

12. The engine of claim 1 wherein, in use, the crossover valve remains open during at least a portion of a combustion event in the expansion cylinder.

13. The engine of claim 12 wherein substantially at least 5% of the total combustion event occurs prior to the crossover valve closing.

14. The engine of claim 12 wherein substantially at least 10% of the total combustion event occurs prior to the crossover valve closing.

15. The engine of claim 12 wherein substantially at least 15% of the total combustion event occurs prior to the crossover valve closing.

16. An engine comprising:

a crankshaft, rotating about a crankshaft axis of the engine;

an expansion piston slideably received within an expansion cylinder and operatively connected to the crankshaft such that the expansion piston reciprocates through an expansion stroke and an exhaust stroke of a four stroke cycle during a single rotation of the crankshaft;

a compression piston slidably received within a compression cylinder and operatively connected to the crankshaft such that the compression piston reciprocates through an intake stroke and a compression stroke of the same four stroke cycle during the same rotation of the crankshaft;

a crossover passage interconnecting the compression and expansion cylinders, the crossover passage including an inlet valve and a crossover valve defining a pressure chamber therebetween; and a fuel injection system operable to add fuel to the exit end of the crossover passage wherein combustion is initiated in the expansion cylinder.

17. The engine of claim 16, wherein the fuel injection system is configured to add fuel to the exit end of the crossover passage, timed to correspond with the crossover valve opening time.

18. The engine of claim 16 comprising the expansion piston and the compression piston having a TDC phasing of substantially 50° crank angle or less.

19. The engine of claim 16 comprising the expansion piston and the compression piston having a TDC phasing of less than 30° crank angle.

20. The engine of claim 16 comprising the expansion piston and compression piston having a TDC phasing of substantially 25° crank angle or less.

21. The engine of claim 16 comprising the crossover valve duration of substantially 50° of crank angle or less.

22. The engine of claim 16 comprising the crossover valve having a crossover valve duration of substantially 35° of crank angle or less.

23. The engine of claim 16 wherein the crossover valve remains open during at least a portion of a combustion event in the expansion cylinder.

24. The engine of claim 23 wherein substantially at least 5% of the total combustion event occurs prior to the crossover valve closing.

25. The engine of claim 23 wherein substantially at least 10% of the total combustion event occurs prior to the crossover valve closing.

26. The engine of claim 23 wherein substantially at least 15% of the total combustion event occurs prior to the crossover valve closing.

27. An engine of claim 16, wherein the crossover valve has a crossover valve duration of substantially 69° of crank angle or less.

28. An engine of claim 16, wherein the crossover valve is outward-opening.

29. The engine of claim 28 wherein the ratio of cylinder volumes from bottom dead center (BDC) to top dead center (TDC) for either one of the expansion cylinder and compression cylinder is 40 to 1 or greater.

30. The engine of claim 29 wherein the ratio of cylinder volumes from BDC to TDC for either one of the expansion cylinder and compression cylinder is 80 to 1 or greater.

* * * * *